US006011521A

United States Patent [19]

Knop et al.

[11] Patent Number: 6,011,521

[45] Date of Patent: Jan. 4, 2000

[54] BROADBAND OMNIDIRECTIONAL MICROWAVE PARABOLIC DISH-SHAPED CONE ANTENNA

[75] Inventors: Charles M. Knop, Lockport; Edward L. Ostertag, New Lenox; Gregory S. Orseno; Robert Gunnels, both of Lockport, all of Ill.

[73] Assignee: Andrew Corporation, Orland Park, Ill.

[21] Appl. No.: 08/840,603

[22] Filed: Apr. 22, 1997

Related U.S. Application Data

[63] Continuation-in-part of application No. 08/610,359, Mar. 4, 1996, abandoned.

[51] Int. Cl.[7] ..... H01Q 19/19

[52] U.S. Cl. ..... 343/781 P; 343/840

[58] Field of Search ..... 343/781 P, 781 CA, 343/840; H01Q 15/00

[56] References Cited

U.S. PATENT DOCUMENTS

| | | | |
|---|---|---|---|
| 2,416,698 | 3/1947 | King | 343/781 R |
| 3,747,116 | 7/1973 | Milam | 343/837 |
| 4,263,599 | 4/1981 | Bielli et al. | 343/781 R |
| 4,672,387 | 6/1987 | Waddoup et al. . | |
| 4,827,277 | 5/1989 | Becker et al. | 343/781 |
| 5,486,838 | 1/1996 | Dienes | 343/781 R |

FOREIGN PATENT DOCUMENTS

| | | | |
|---|---|---|---|
| 0 131 512 A1 | 1/1985 | European Pat. Off. | H01Q 19/10 |
| 0131512 | 1/1985 | European Pat. Off. | 343/781 R |
| 0 235 884 A1 | 9/1987 | European Pat. Off. | H01Q 19/10 |
| 0678930 | 10/1995 | European Pat. Off. | H01Q 19/13 |
| 2334216 | 7/1977 | France | 343/781 R |
| 1616252 | 3/1971 | Germany | 343/781 R |
| 2600944 | 7/1976 | Germany | 343/781 R |
| 60-264106 | 12/1985 | Japan | H01Q 19/18 |
| 578018 | 6/1946 | United Kingdom . | |
| 0805478 | 12/1958 | United Kingdom | H04D 40/07 |
| 805478 | 12/1958 | United Kingdom . | |
| 1136174 | 12/1968 | United Kingdom | H01G 19/18 |
| 1459697 | 12/1976 | United Kingdom | H01Q 1/12 |
| 2155245 | 9/1985 | United Kingdom | H01Q 19/10 |
| 2311169 | 9/1997 | United Kingdom | H01Q 19/19 |

OTHER PUBLICATIONS

Hines, The Electrical Characteristics of the Conical Horn–Reflector Antenna, *The Bell System Technical Journal*, Jul. 1963, pp. 1187–1194.

Colman et al. "W Sidelobe Antennas for Millimeter Wave Communication Systems" Electronics Technology Div. of Naval Research Lab., Washington, D.C. pp. 240–243.

Jakeichi et al., "The Omnidirectional Horn Reflector Antenna," G–AP International Symposium, Sep. 14–16, 1970, pp. 40–47.

M. Orefice and P. Pininoli, "Dual Reflector Antenna With Narrow Broadside Beam for Omnidirectional Coverage," Electronics Letters, vol. 29, No. 25, Dec. 9, 1993, pp. 2158–2159.

M. Orefice et al., "A Dual Reflector Antenna For Omnidirectional Coverage," IEEE Antennas and Propagation Society International Symposium 1993, 1993 International Symposium Digest Antennas and Propagation, vol. 1, Jun. 28–Jul. 2, 1993, pp. 274–277.

*Primary Examiner*—Michael C. Wimer
*Attorney, Agent, or Firm*—Arnold, White & Durkee

[57] ABSTRACT

An omnidirectional microwave antenna comprises a paraboloidal reflector disposed above the ground and facing downwardly with a substantially horizontal aperture and a substantially vertical axis. A vertically oriented feed horn is located below the paraboloidal reflector on the axis of the paraboloidal reflector and has a phase center located near the focal point of the paraboloidal reflector. A conical reflector having a shaped reflecting surface defined by the parameters of a mathematical equation extends downwardly away from the periphery of the feed horn for reflecting radiation received vertically from the paraboloidal reflector in a horizontal direction away from the conical reflector, and for reflecting horizontally received radiation vertically to the paraboloidal reflector. A radome extends downwardly from the outer periphery of the paraboloidal reflector and includes an absorber material for absorbing radiation propagated laterally from the feed horn and the conical reflector above the aperture of the feed horn.

11 Claims, 21 Drawing Sheets

Note: The phase is virtually flat over ± 70°

Measured (a) $TM_{01}$ and (b) $TE_{01}$ Mode Horn Patterns at GHz Vertical and Horizontal Polarizations, Respectively.

Measured Elevation-Plane Patterns - Vertical Polarization of 28 GHz
LMDS Antenna, f=28.50 GHz.

PREDICTED RADIATION PATTERNS OF VARIOUS PARABOLIC DISH-SHAPED CONE ANTENNA FOR: (a) CONE SHAPE OF $y_s = -x_s$ WITH HT = 2.50", d = 0.27", (b) CONE SHAPE OF $y_s = -x_s$ WITH HT = 0, d = 0.27", (c) CONE SHAPE OF $y_s = -x_s - (x_s - 7500)^3/1500$, WITH HT = d = 0.

Predicted Aperture Power and Phase Distributions for Various Parabolic Dish-Shaped Cone Antennas, f = 28.5 GHz.

Predicted and Measured Vertically Polarized Radiation Pattern for Parabolic Dish-Shaped Cone Antenna, f = 28.5 GHz Predicted Horizontally and Vertically Polarized Radiation Patterns of Parabolic Dish-Shaped Cone Antenna, f = 28.5 GHz.

BROADBAND OMNIDIRECTIONAL MICROWAVE PARABOLIC DISH-SHAPED CONE ANTENNA

CROSS REFERENCE TO RELATED APPLICATIONS

This application is a continuation-in-part of U.S. patent application Ser. No. 08/610,359, filed Mar. 4, 1996 and entitled "A Broadband Omnidirectional Microwave Antenna With Decreased Sky Radiation and With a Simple Means of Elevation-Plane Pattern Control", abandoned. The parent application has the same assignee as the present invention and is incorporated herein by reference in its entirety.

FIELD OF THE INVENTION

The present invention relates generally to omnidirectional microwave antennas and, more particularly, to omnidirectional microwave antennas which are capable of controlling the shape of radiation towards the earth while reducing the amount of radiation toward and into the upper hemisphere.

BACKGROUND OF THE INVENTION

There are a number of new microwave distribution systems under development using frequencies above 10000 MHz. Inter-satellite communications use the 28000 MHz frequency range. Multi-channel or interactive television would use the 27500–29500 MHz frequency range, while some wireless cable operators are opting for the 12 GHz CARS band. This activity has prompted a strong interest in base station antennas (similar to broadcast station antennas). The antennas need to operate over a fairly wide bandwidth with a moderate to high power input. The azimuth-plane coverage requirement, in most cases, is omnidirectional, while the elevation-plane coverage is specified (in various forms) for radiation towards the earth and is, usually, to be minimized towards the sky. The polarization may be either horizontal or vertical.

Omnidirectional antennas are traditionally linear arrays of basic radiating elements such as slots or dipoles. However, the requirement for broad band operation is not compatible with linear array technology. The problem is further complicated by the relatively high power requirements (up to 2 Kw) at these high frequencies.

SUMMARY OF THE INVENTION

It is a primary object of the present invention to provide an improved omnidirectional antenna which is a reflector-type antenna capable of operating over a wide frequency band, at relatively high power levels, and at millimeter wave frequencies. Specifically, it is an object of this invention to provide such an antenna which is capable of operating at frequencies above 10 GHz, including the 27.5 to 29.5 GHz band, and at much higher power levels of hundreds of watts.

It is another object of this invention to provide such an improved omnidirectional antenna which facilitates a more accurate achievement of a specified shaped elevation beam, which is stable with frequency, by shaping one of the reflecting surfaces according to a mathematical formula;

A further object of this invention is to provide such an improved omnidirectional antenna which permits field-adjustable elevation-plane beam tilt by simply moving the feed along the axis of the antenna.

A still further object of this invention is to provide such an improved omnidirectional antenna which has a simple method of controlling the shape of the elevation-plane radiation towards the earth, where this pattern shape remains stable as the frequency changes. This simple method consists of the judicious choice of absorber-shield placement in the antenna.

Yet another object of this invention is to provide an improved omnidirectional antenna which reduces the amount of radiation toward and into the upper hemisphere so as to avoid interference with satellite communications.

Still yet another object of this invention is to provide an improved omnidirectional antenna which can transmit and receive signals having either horizontal or vertical polarization.

Other objects and advantages of the invention will be apparent from the following detailed description and the accompanying drawings.

In accordance with the present invention, the foregoing objectives are realized by providing an omnidirectional microwave antenna consisting of a paraboloidal reflector illuminated by a circular horn antenna situated at, or near, the apex of a shaped metallic cone and at, or near, the focal point of the paraboloid, and where the axes of the cone and paraboloid are coincident, and with the entire cylindrical structure so-formed being enclosed by a radome. The radome acts as a support for the paraboloid and can be judiciously lined (on its inner surface) with absorbing material so as to both reduce the radiation into the upper hemisphere and to control the effective-aperture distribution. The latter provides a simple way to approximately realize a specified elevation-plane pattern directed towards the earth while the former reduces the radiation towards the sky, as discussed below.

BRIEF DESCRIPTION OF THE DRAWINGS

The foregoing and other advantages of the invention will become apparent upon reading the following detailed description and upon reference to the drawings in which.

Figure 1:
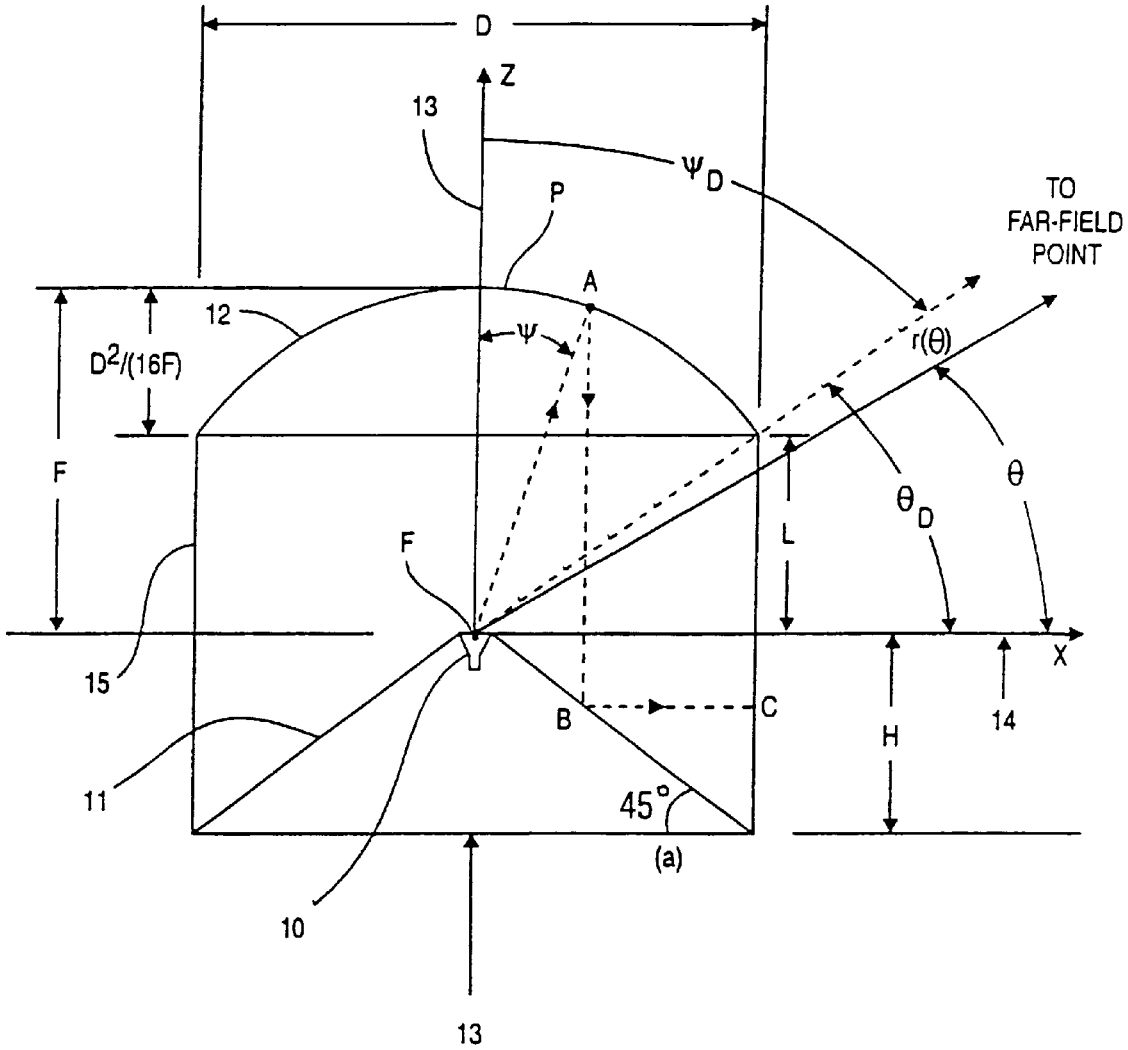
FIG. 1 depicts a vertical cross-section of an antenna consisting of a paraboloid and 45° cone with feed at its apex in accordance with principles of the present invention.

While the invention is susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings and referring initially to FIG. 1, a conical horn 10 situated at the apex of a metallic cone 11, feeds microwave energy to a paraboloidal reflector 12, where the paraboloidal reflector is supported by a radome 15 attached to the base of the cone 11. The feed horn 10 has a circular transverse cross section, and is dimensioned to carry energy in either the TEM, $TM_{01}$ mode or the $TE_{01}$ mode. The horn is located on the vertical axis 13 of the parabolic reflector 12 and radiates microwave energy upwardly so that it illuminates the parabolic reflecting surface and is reflected vertically-downwards therefrom towards the cone. (The term "feed" as used herein, although having an apparent implication of use in a transmitting mode, will be understood to encompass use in a receiving mode as well, as is conventional in the art.)

The parabolic reflecting surface 12 of diameter D is a surface of revolution formed by rotating a parabolic curve P around the vertical axis 13 which passes through the focal point "F". The axis of the feed horn 10 is coincident with the vertical axis 13 of the parabolic reflecting surface 12, and the phase center of the feed horn is approximately coincident with the focal point "F" of the parabolic curve P, and is essentially coincident with the apex of the cone 11 whose axis is aligned coincident with the vertical axis 13. The vertical axis 13 extends through the vertex of the cone and the focal point of the parabolic curve P.

In accordance with principles of the present invention, the surface of cone 11 has a shape governed by the following equation (hereinafter "equation (1)"):

$$Z_s = \sum_{n=0}^{N} A_n (X_s - X_n)^n \tag{1}$$

where the origin ($X_s$=0, $Z_s$=0) is the focal point (point "F") of the parabolic reflecting surface 12, and the coefficients $A_n$, the displacement distances $X_n$ and the number of terms N are chosen so as to give a desired radiation pattern. It will be appreciated, of course, that alternate orientations of the antenna and/or alternate coordinate systems will generally alter the form of equation (1). For example, in a cartesian system defining the Y axis as the vertical axis, the equation is the same as above except with $Y_s$ replacing $Z_s$.

In the embodiment shown in FIG. 1, the conical surface 11 has a shape determined by equation (1) with N=1, the coefficients $A_0$=0 and $A_1$=−1 and the displacement distances $X_0$ and $X_1$=0. Using these parameters, equation (1) reduces to $Z_s$=−$X_s$, which is a mathematical representation of a −45° cone, e.g. with sides directed 45° downward relative to the X axis 14. As is well known, any microwave ray originating from the feed horn at the focal point and propagating up to the parabolic surface will be reflected downward by the parabolic surface parallel to the Z axis 13, and then will be reflected from the conical surface 11 perpendicular to the Z axis in the horizontal direction in FIG. 1. Such a typical ray is shown in FIG. 1 as "F"ABC.

With the geometry described above, the parabolic reflecting surface 12 serves as a collimator of the diverging spherical wave radiated by the feed horn 10. The spherical wave propagates radially from the feed horn 10 and is reflected-collimated by the parabolic surface 12 as a plane wave propagating in the negative vertical direction, then strikes the conical reflector 11 and propagates as a cylindrical wave in the horizontal direction. This cylindrical (which converts to a spherical wave in the far-field) wave is propagated omnidirectionally, i.e., the pattern extends completely around (360°) the Z axis. At any given azimuthal location, the parabolic shape of the reflecting surface 12 and the conical surface 11 provide the desired phase correction so all rays such as "F"ABC are of the same length for the range of the angle $\Psi$ covering $0 \leqq \Psi \leqq \Psi_D$, where $\Psi_D$=2arctan[1/(4F/D)]. The height H (where H=D/2), in conjunction with the size of the horn, determines the directivity of the antenna pattern in the "elevation" plane, where the elevation plane is defined by the angle to a far-distant distant point r(θ), with −90°≦θ≦90°, with negative values being directed toward the earth, and positive values towards the sky, and with θ=0 toward the horizon.

The mode of radiation from the feed horn 10 determines the polarization of the antenna's omnidirectional pattern.

Specifically, if the horn 10 radiates a TEM or $TM_{01}$-mode energy, the polarization is vertical; and if the horn radiates $TE_{01}$-mode energy, the polarization is horizontal. Thus, by merely changing the feed horn the same antenna may be used to transmit or receive either polarization.

Figure 2:
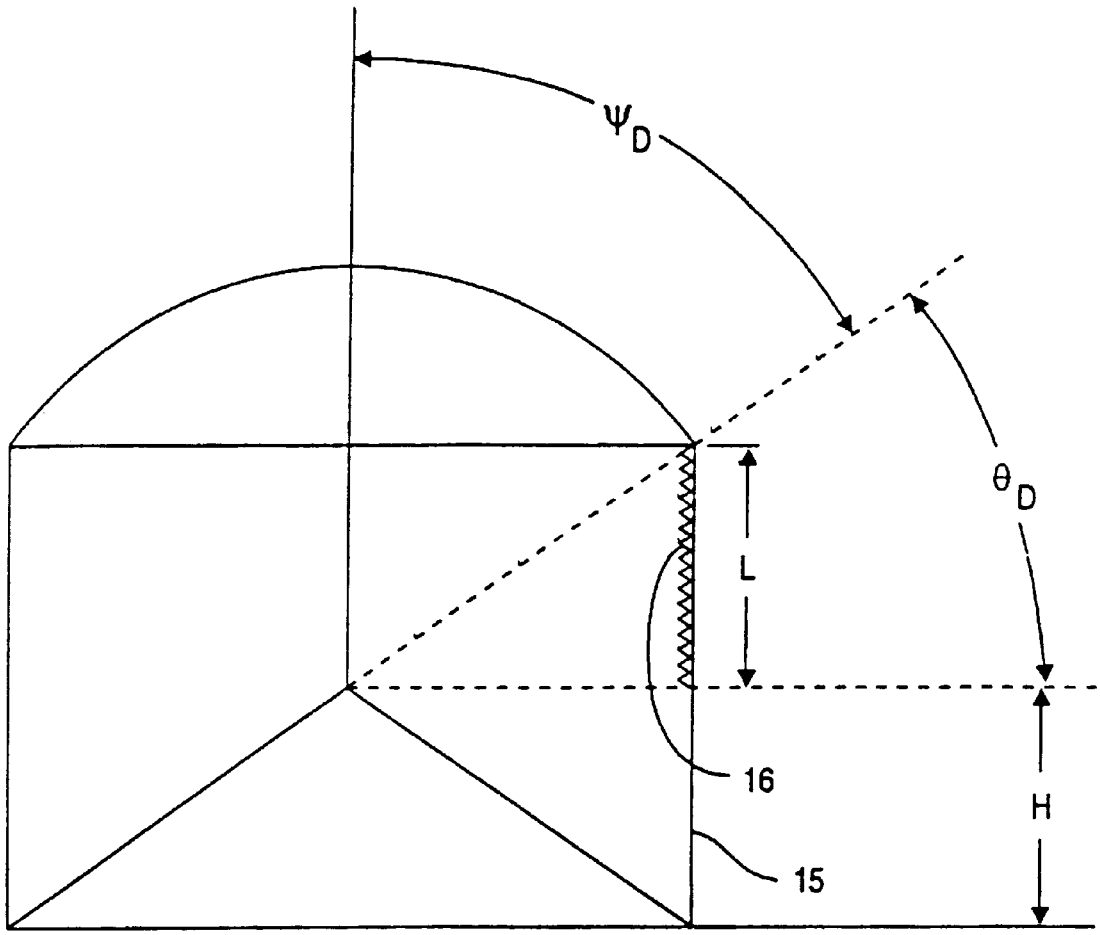
FIG. 2 is a diagrammatic illustration of a modification of the antenna of FIG. 1.
Figure 3B:
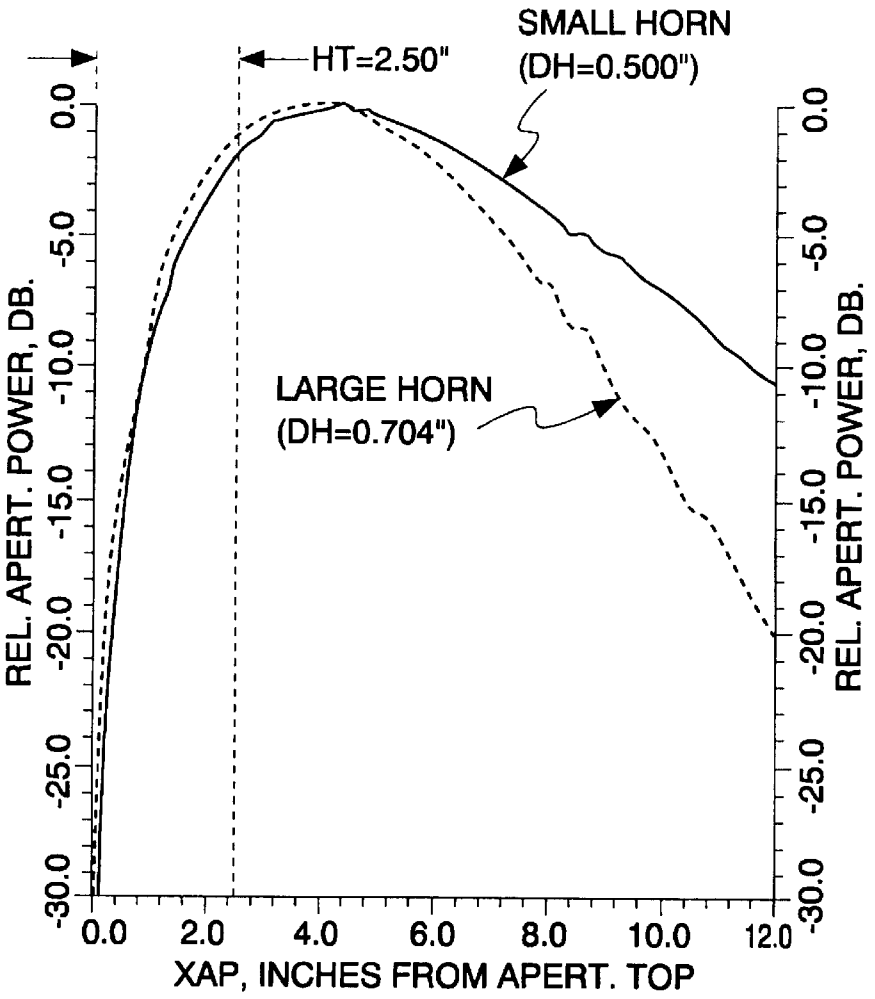
FIG. 3*b* is a pair of predicted aperture power distribution curves corresponding to the two patterns of FIG. 3*a*.
Figure 3A:
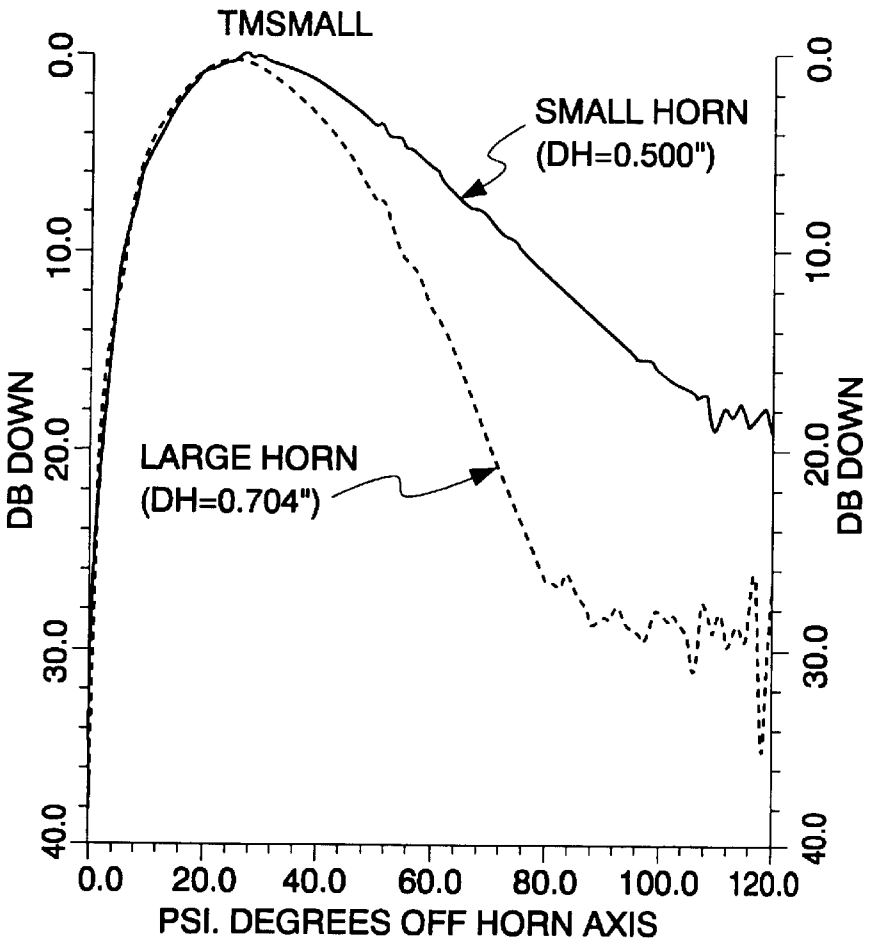
FIG. 3*a* is a pair of measured horn patterns produced by a large and small horn which may be utilized to feed any of the antennas of the present invention.

To suppress the amount of radiation toward and into the upper hemisphere, thereby preventing interference with inter-satellite communications, an absorber lining 16 (FIG. 2) is placed on the inner surface of the radome 15 over the distance L (where $L=F-[D^2/(16F)]$. This absorbtive material absorbs the radiation impinging on it. In the absence of this material, the horn radiation in the region $0 \leqq \theta \leqq \theta_D$ (where $\theta_D=90-\Psi_D$) would travel into the upper hemisphere. The absorptive material prevents this radiation by absorbing it and converting it to heat. The improved performance (i.e., reduced level of sky radiation in the angular region of $0 \leqq \theta \leqq \theta_D$) will be shown for an antenna having dimensions of D=24.00" and F=9.00" (so L=5.00" and $\Psi_D=67.38°$) and operated at 28.5 GHz. Using a $TM_{01}$ horn of diameter $D_H=0.500"$ and utilizing a quarterwave peripheral choke to reduce horn radiation for $\Psi \geqq 75°$, the antenna produced a measured pattern which is shown in FIG. 3*a* and the predicted aperture power distribution shown in FIG. 3*b*. Examination of the horn pattern of FIG. 3*a* shows that a significant amount of radiation exists in the region $67.38° \leqq \Psi \leqq 90°$ (i.e., where the horn illuminates the region L).

Figure 4A:
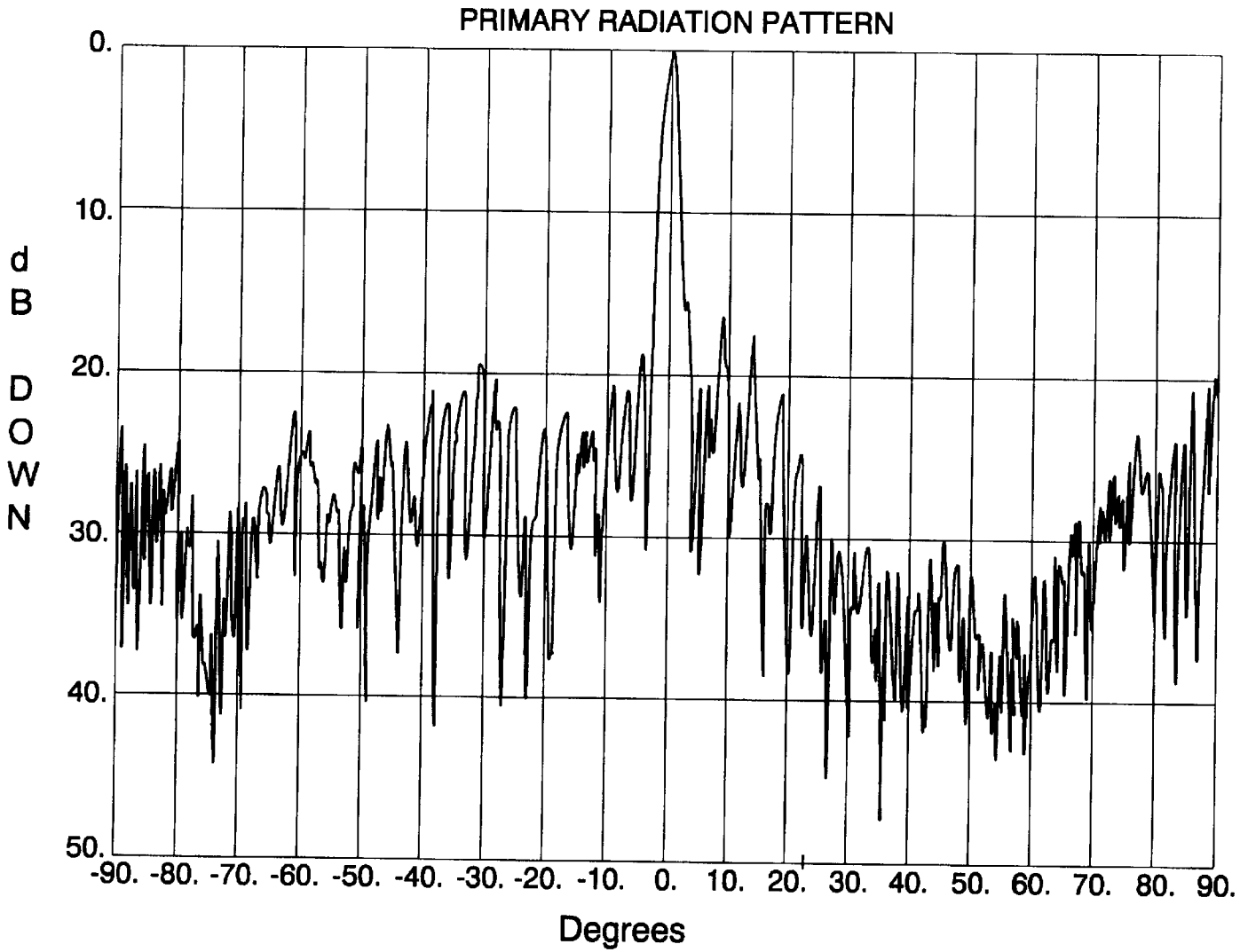
FIG. 4*a* is a measured elevation-plane pattern produced by an antenna of the type depicted in FIG. 1 with a small feed horn.
Figure 4B:
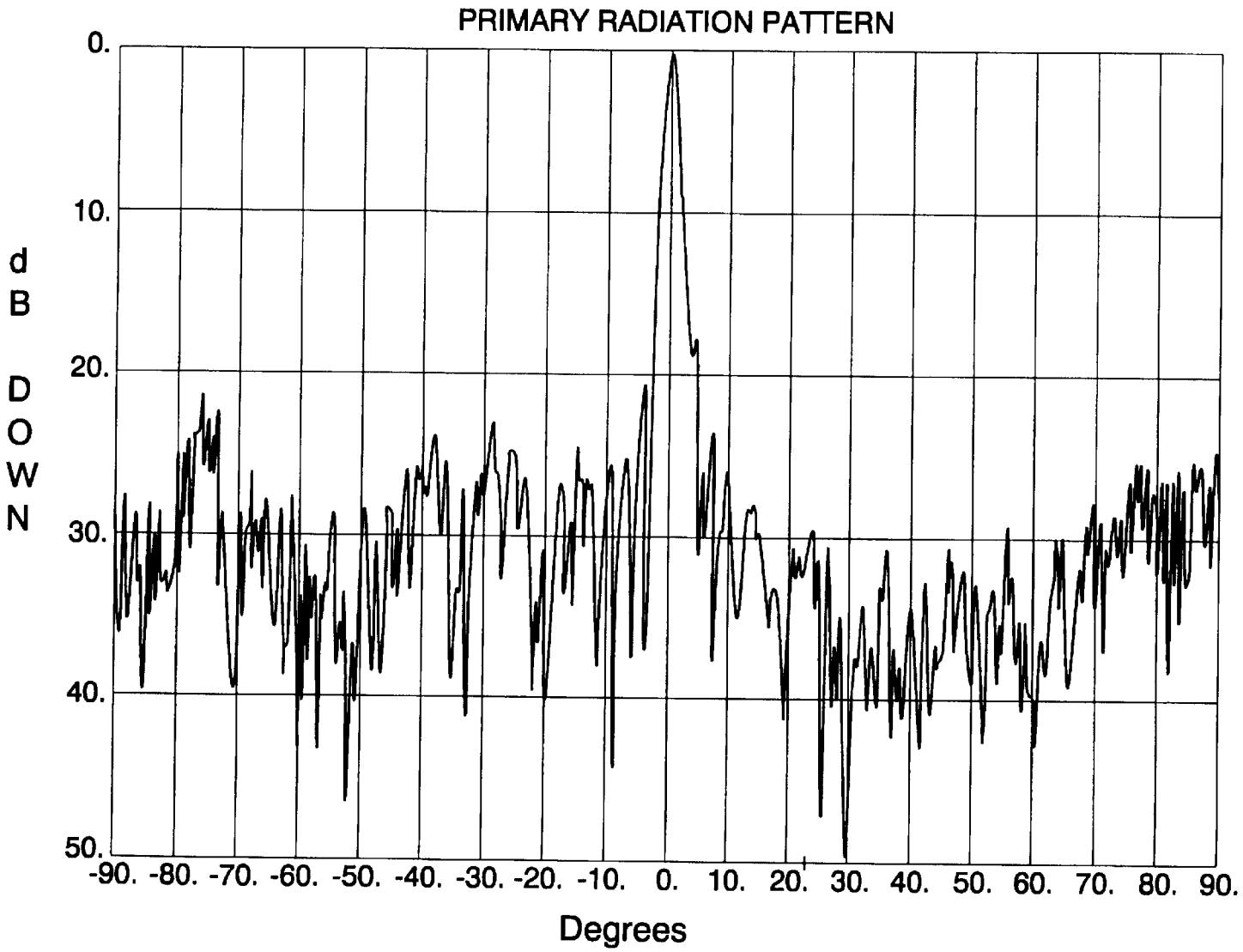
FIG. 4*b* is a measured elevation-plane pattern produced by an antenna of the type depicted in FIG. 2 with a small feed horn.
Figure 4C:
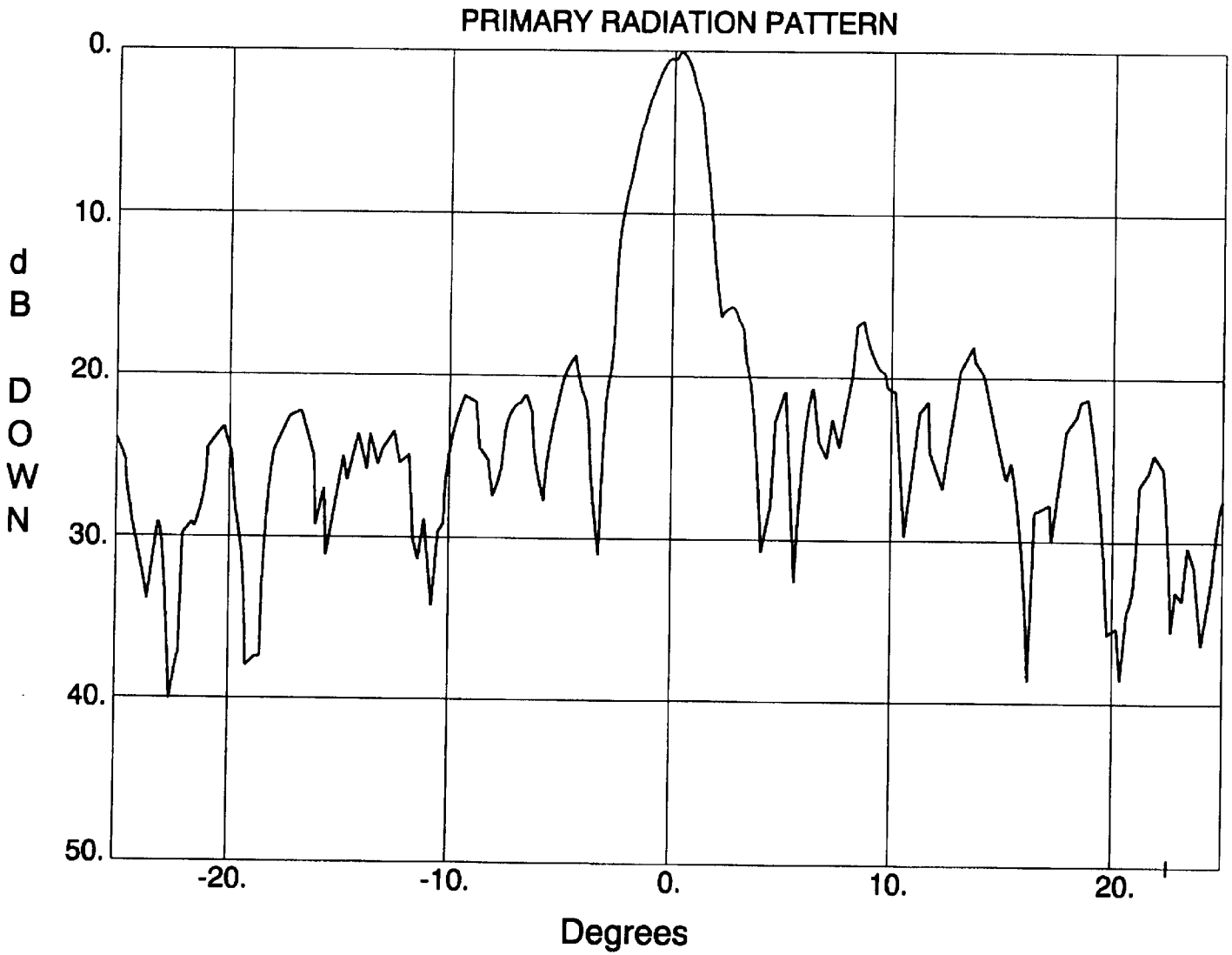
FIG. 4*c* is another measured pattern produced by the antenna of FIG. 1 with a small feed horn.
Figure 4D:
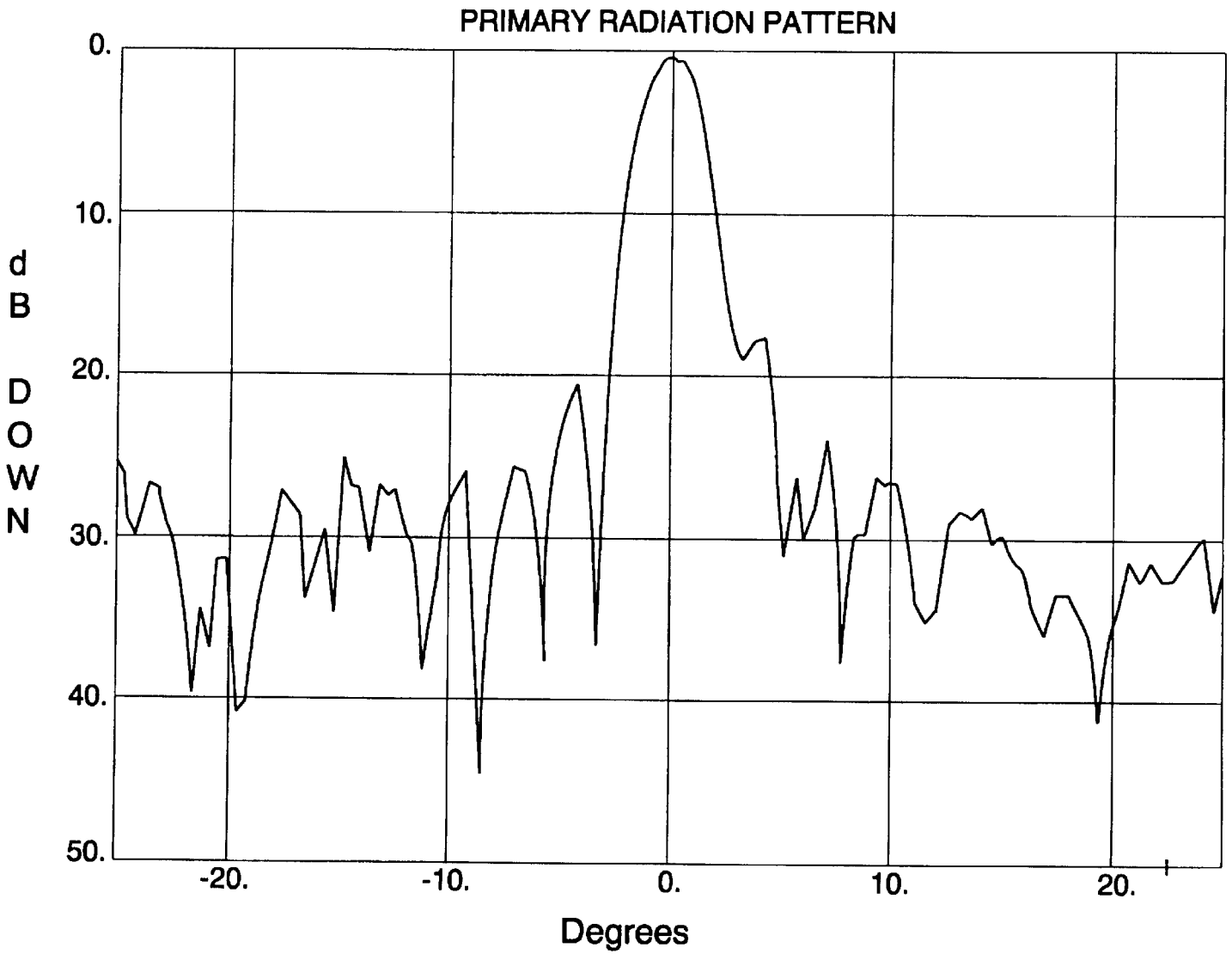
FIG. 4*d* is another measured pattern produced by the antenna of FIG. 2 with a small feed horn.

FIGS. 4*a* and 4*c* illustrate the measured elevation-plane pattern produced by the antenna with no absorber lining in the region L, while FIGS. 4*b* and 4*d* illustrate the measured elevation-plane pattern produced by the antenna with absorber lining in the region L. In the absence of the absorber lining in the region L (FIGS. 4*a* and 4*c*), the horn energy radiates into the sky in the region $0 \leqq \theta \leqq \theta_D$ (where $\theta_D=90-\Psi_D=22.62°$ in the present example) and adds with the radiation produced by the fields in the effective aperture, H, giving the measured pattern of FIGS. 4*a* and 4*c*. With the absorber lining present on the inner surface of the radome over the distance L, the horn energy the region $0 \leqq \theta \leqq 22.62°$ is absorbed by the absorber and hence is no longer radiated. Thus, there is a significantly lower level of radiation in the $0 \leqq \theta \leqq 22.62°$ region (and thereby reduced interference to satellite communication systems) with absorber lining present (FIG. 4*b* and 4*d*) than with no absorber lining present (FIGS. 4*a* and 4*c*). This can be seen most clearly by comparing FIG. 4*c* with FIG. 4*d*.

Figure 3C:
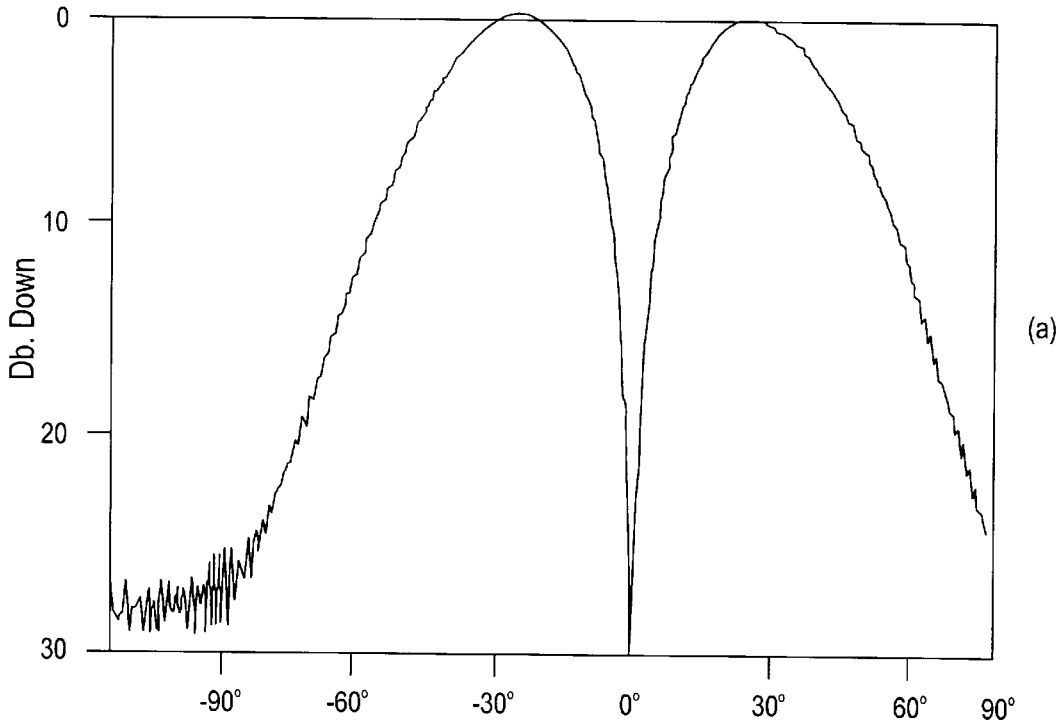
FIG. 3*c* is a measured horn pattern produced by a large horn at vertical polarization which may be utilized to feed any of the antennas of the present invention.
Figure 3D:
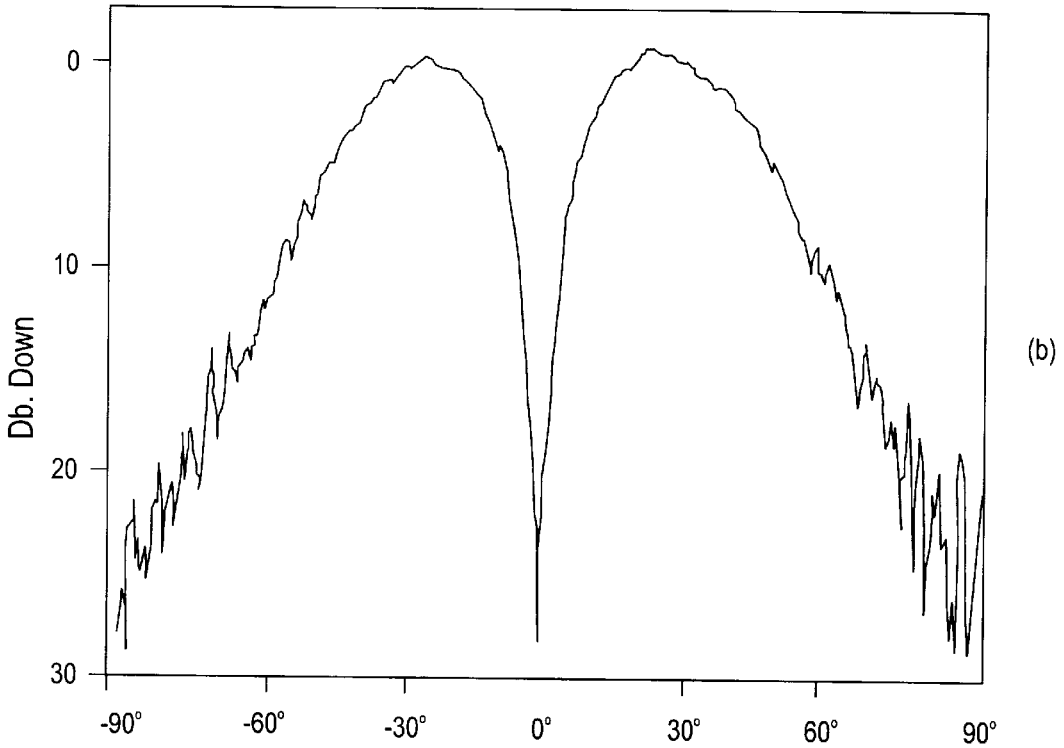
FIG. 3*d* is a measured horn pattern produced by a large horn at horizontal polarization which may be utilized to feed any of the antennas of the present invention.

A similar, though smaller, improvement may be achieved by using a moderately larger horn diameter such as $D_H=0.704"$. The measured pattern produced by the larger horn operated at 28.5 GHz vertical polarization is shown in FIG. 3*a* alongside that of the smaller horn. As can be observed in FIG. 3*a*, the amount of radiation in the region $67.38° \leqq \Psi \leqq 90°$ is less with the larger horn than with the smaller horn. The size of horn employed depends on the gain and sidelobe level desired in the elevation-plane pattern. A smaller horn gives higher directive-gain and higher sidelobes, while a larger horn gives lower directive-gain and lower sidelobes. The predicted aperture power distribution of the larger horn is shown in FIG. 3*b*. FIG. 3*c* presents an isolated view of the $TM_{01}$ pattern (to obtain vertical polarization) and FIG. 3*d* shows the $TE_{01}$ pattern (to obtain horizontal polarization) of the larger horn.

Figure 5A:
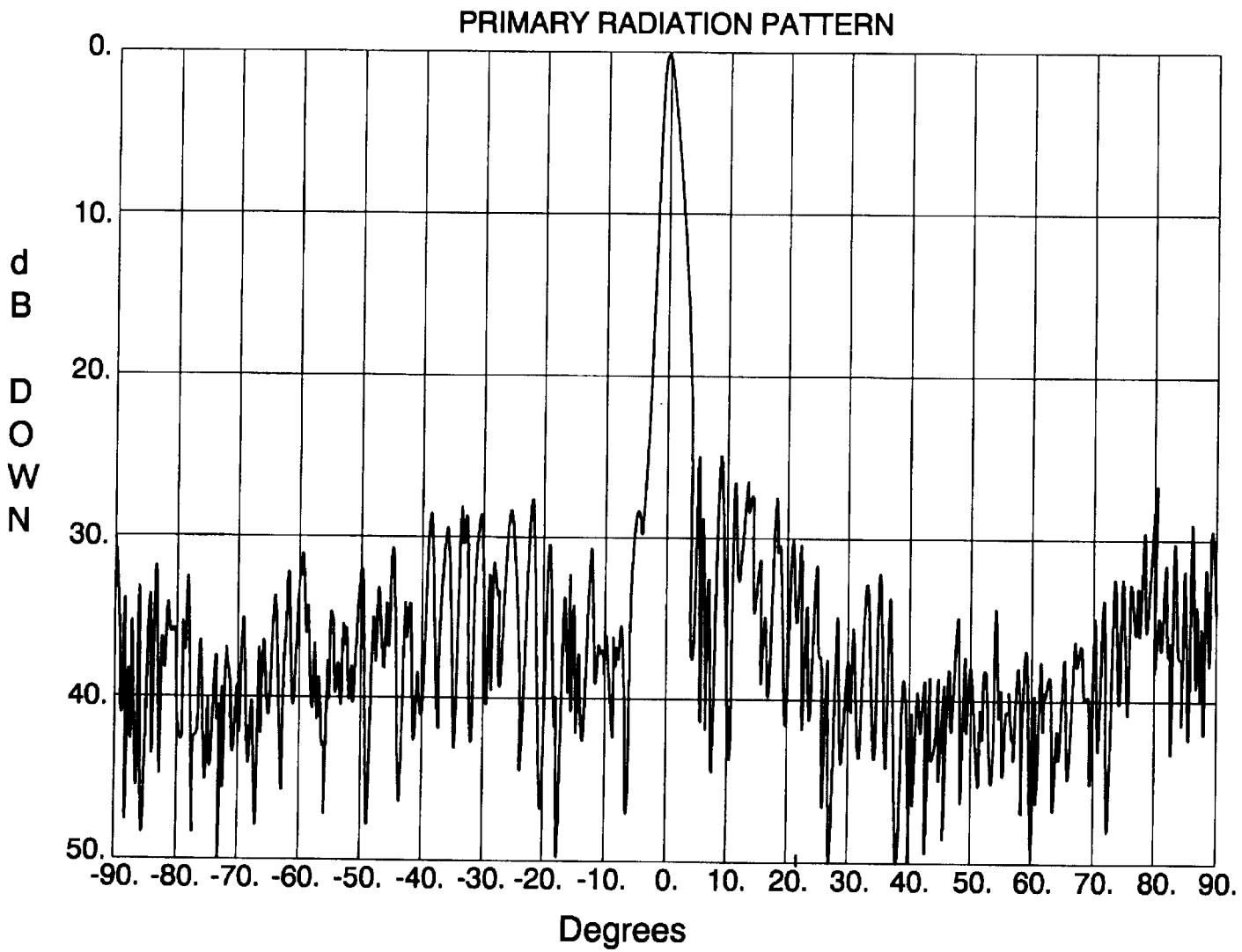
FIG. 5*a* is a measured elevation-plane pattern produced by an antenna of the type depicted in FIG. 1 with a large feed horn.
Figure 5B:
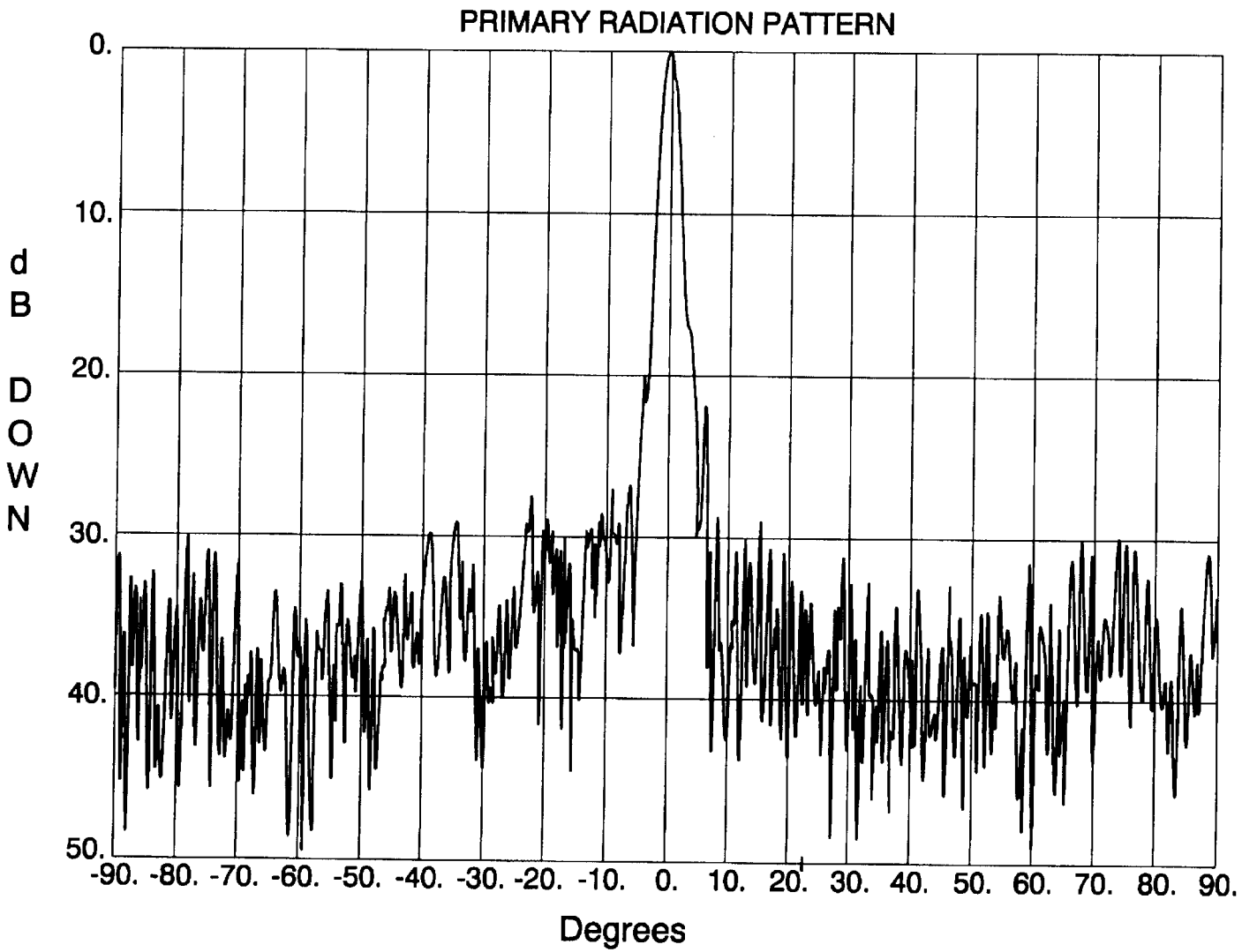
FIG. 5*b* is a measured elevation-plane pattern produced by an antenna of the type depicted in FIG. 2 with a large feed horn.
Figure 5C:
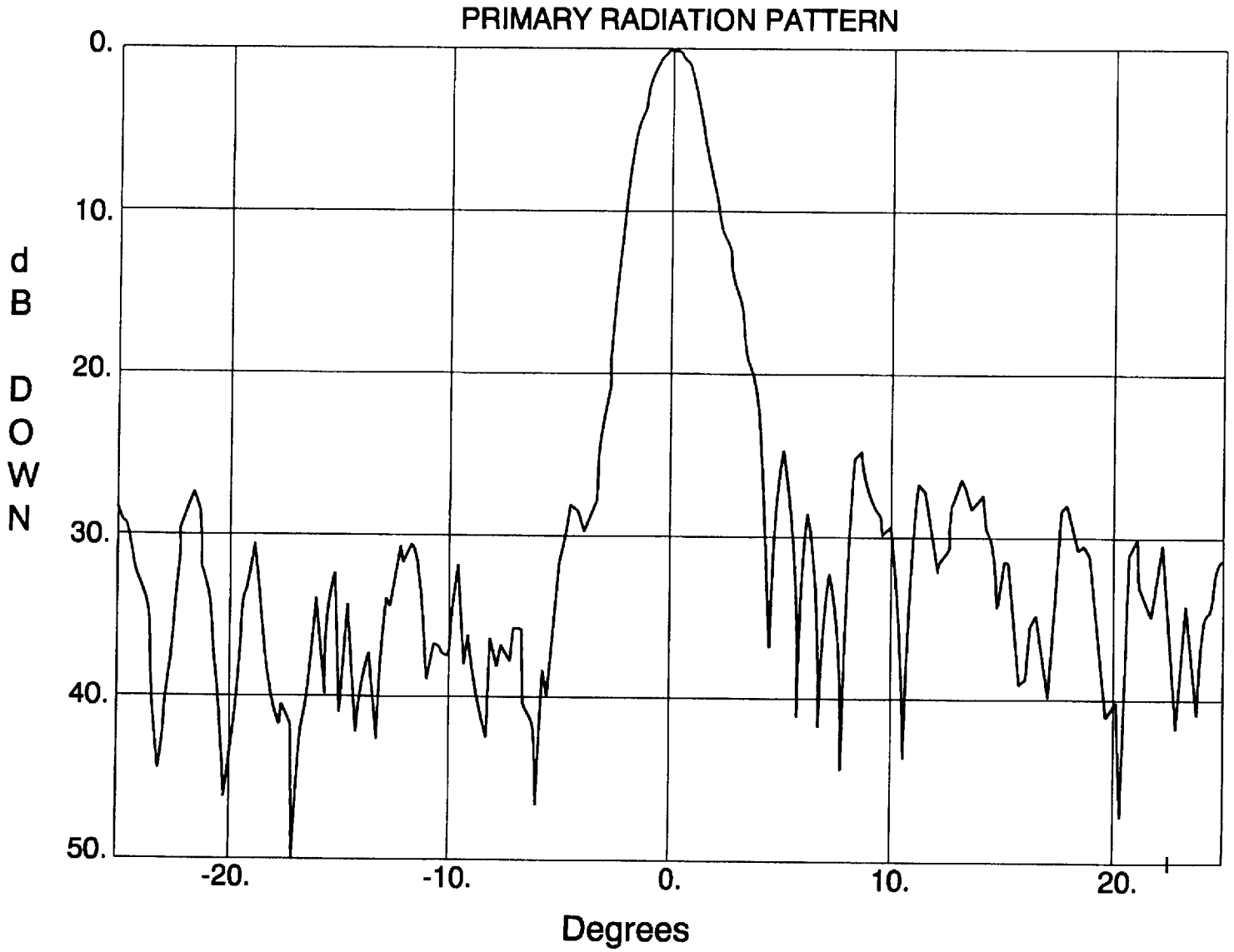
FIG. 5*c* is another measured elevation-plane pattern produced by the antenna of FIG. 1 with a large feed horn.
Figure 5D:
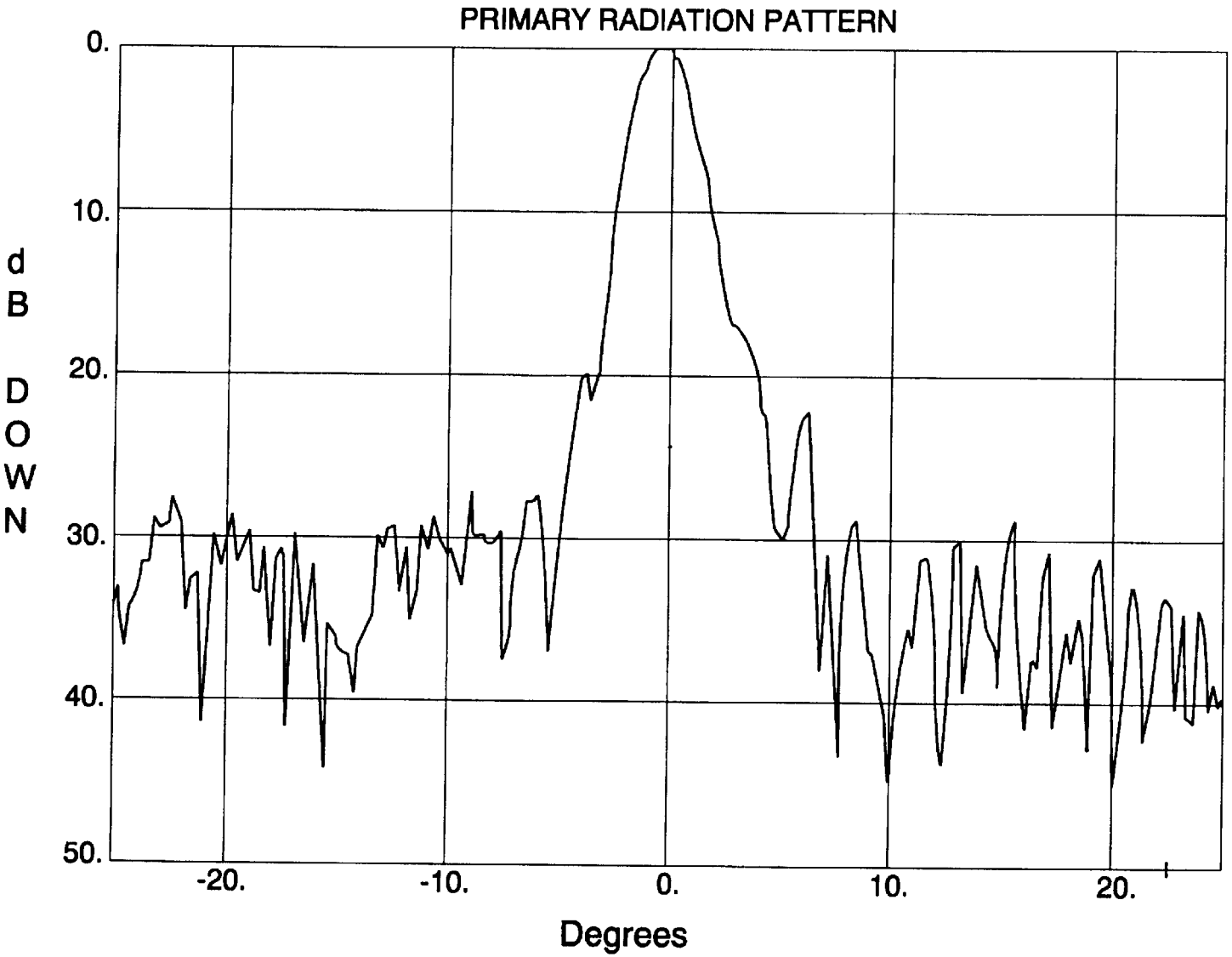
FIG. 5*d* is another measured elevation-plane pattern produced by the antenna of FIG. 2 with a large feed horn.

FIGS. 5*a* and 5*c* show the measured elevation-plane pattern produced by the larger-horn antenna with no absorber lining in the region L, while FIGS. 5*b* and 5*d* show the measured elevation-plane pattern produced by the same antenna with absorber lining in the region L. Similar to the smaller-horn case discussed above, it can be observed that there is a significantly lower level of radiation in the $0 \leqq \theta \leqq 22.62°$ region with absorber lining present (FIGS. 5*b* and 5*d*) than with no absorber lining present (FIGS. 5*a* and 5*c*).

Figure 6:
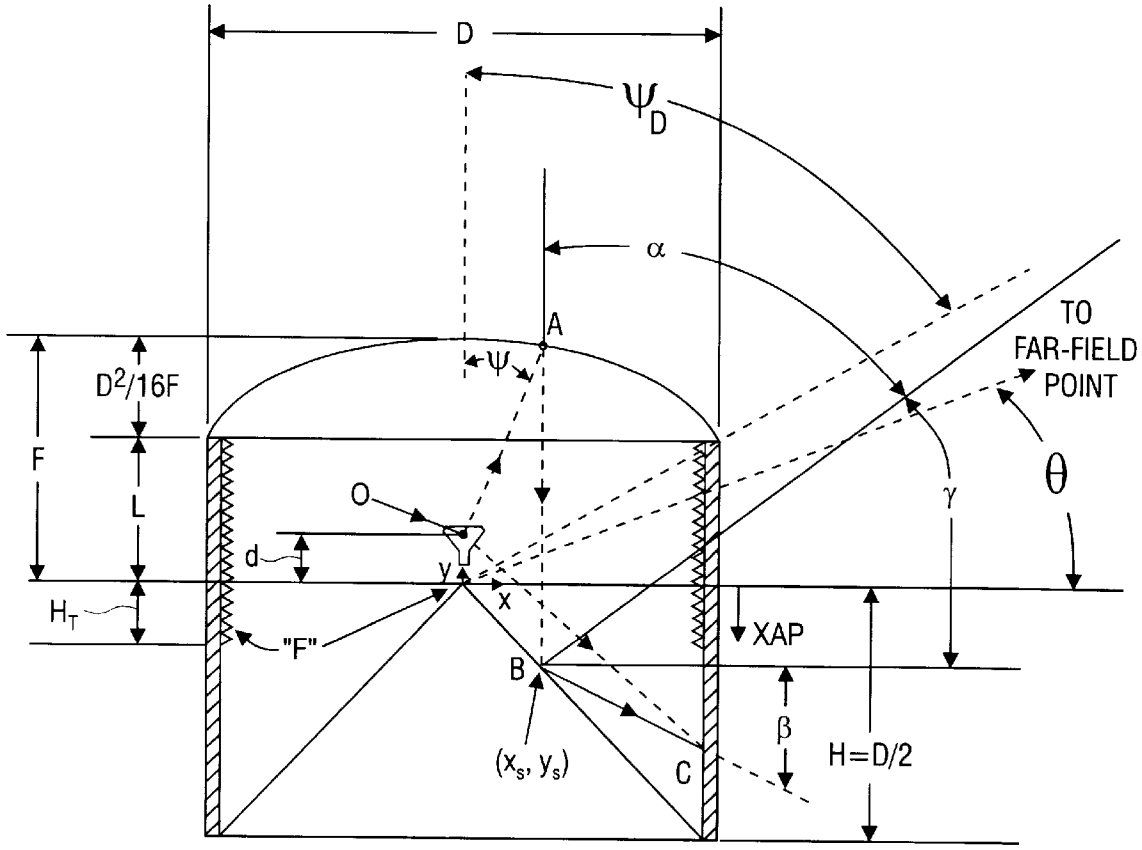
FIG. 6 is a diagrammatic illustration of another modification of the antenna of FIG. 1.

FIG. 6 illustrates another embodiment of the present invention in which the feed horn is positioned a distance "d" above the dish's focal point "F", and in which the absorber lining is extended a distance $H_T$ beyond the distance L. The former serves to tilt the beam below the horizon by an angle $\Delta\theta$ so as not to "waste" radiation to and above the radio horizon, and the latter provides an added measure of pattern control (e.g., an even higher level of ground radiation with its nulls filled).

The mathematical relationship between d and $\Delta\theta$ is expressed by the equation $d=[(D/2)\tan(\Delta\theta)]/[\cos\Psi_T-\cos\Psi_D]$, where $\Psi_T=2\arctan[H_T/(2F)]$. For example, in the case where D=24.00", H=12.00", F=9.00" and $H_T=2.5"$ (so $\Psi_D=67.38°$ and $\Psi_T=15.81°$), $d=[(12)\tan(\Delta\theta)]/[\cos 15.81°-\cos 67.38°]$. Thus, if it is desired to achieve a beam tilt of $\Delta\theta=0.75°$, $d=[(12)\tan(0.75°)]/0.577=0.27"$.

With the absorber lining extended a distance $H_T$ (2.5" in the present example) beyond the distance L, the aperture is effectively blocked from $0 \leqq X_{AP} \leqq H_T$. The effective aperture of the antenna shown in FIG. 6 thereby has a length of $H-H_T$ (e.g., 9.5"), with the top edge of the aperture defined by $X_{AP}=H_T=2.5"$ and the bottom edge of the aperture defined by $X_{AP}=H=12.00"$. For purposes of comparison, it is recalled that with the absorber lining equal to the distance L (FIG. 2), the top edge of the aperture is defined by $X_{AP}=0$ and the bottom edge defined by $X_{AP}=12.00"$.

The effect of extending the absorber lining by a distance $H_T$ beyond the distance L will be described initially with reference to FIGS. 3*a* through 3*d*. First referring to FIGS. 3*a* or 3*b*, it is noted that the $TM_{01}$ horn pattern (large-horn case) has a null on its axis ($\Psi=0$), then rises, then falls again as $\Psi$ approaches $\Psi_D$ (67.38°). Similarly, FIG. 3*c* shows that the $TE_{01}$ horn pattern in the large-horn case has a null at $\Psi=0$, then rises, then falls again at about $\Psi=67.38°$. Now referring to FIG. 3*d* (large-horn case), it is noted that with the absorber lining equal to the distance L (as in FIG. 2), both the top of the aperture ($X_{AP}=0$) and the bottom of the aperture ($X_{AP}=12.00"$) are at almost the same illumination level. In other words, neither edge is illuminated at a significantly different level than the other. In contrast, with the absorber extended beyond the distance L (as in FIG. 6), the top of the aperture ($X_{AP}=2.5"$) is illuminated at a higher ("hotter") level than the bottom edge ($X_{AP}=12.00"$).

Figures 7A, 7B:
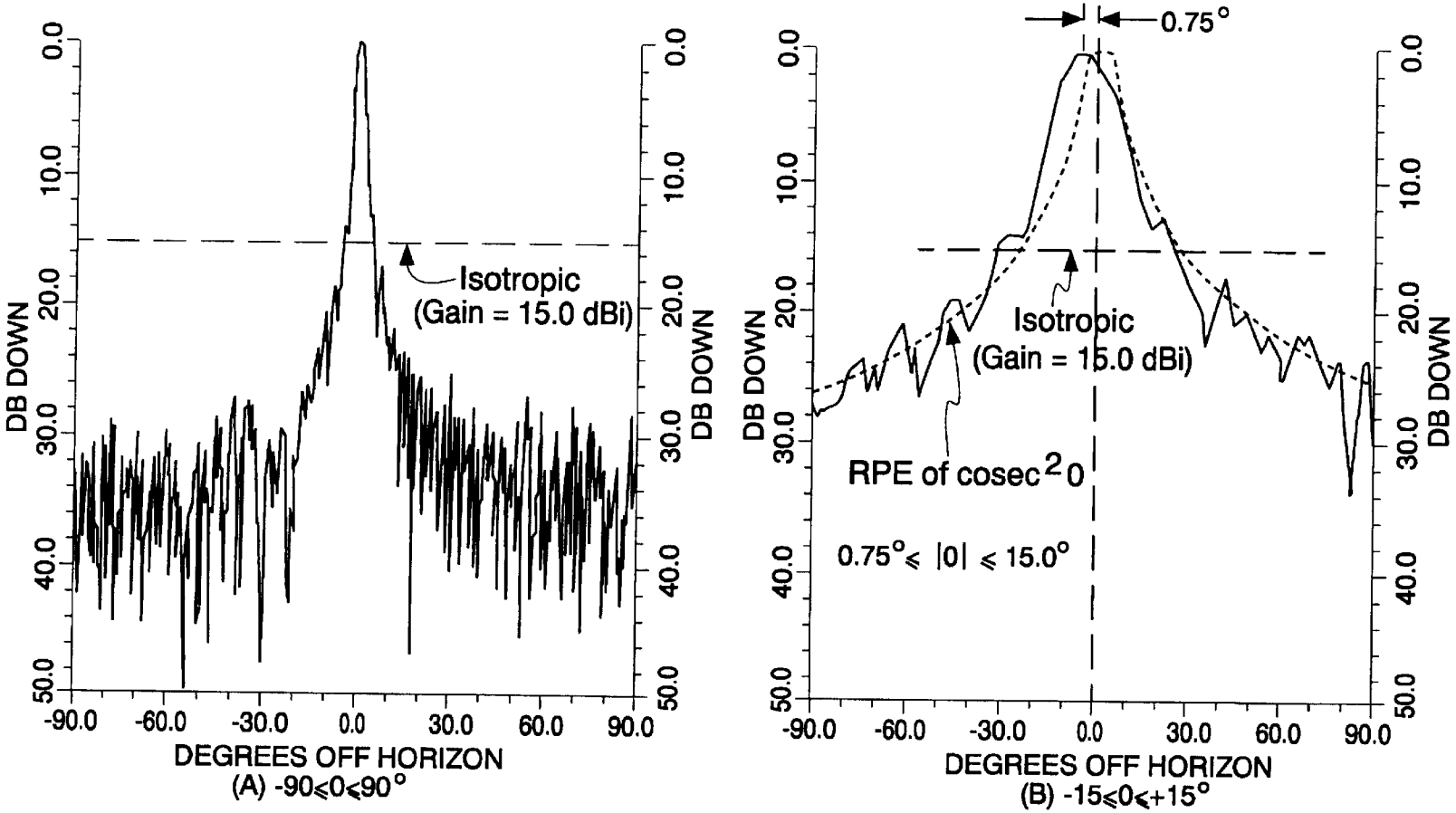
FIGS. 7*a* and 7*b* show measured antenna patterns corresponding to the antenna of FIG. 6.

This aperture distribution gives rise to the measured radiation pattern shown in FIGS. 7*a* and 7*b*. It is noted that the radiation patterns of FIGS. 7*a* and 7*b* are centered at $\theta=0.75°$ because of the displacement (d=0.27") of the feed horn. If no displacement were made, virtually the same pattern would be obtained but with its peak at $\theta=0°$ rather than $\theta=0.75°$. Examination of these patterns (and comparing them with those of FIGS. 5*b* and 5*d*) shows that the radiation pattern in the region of $-15° \leqq \theta \leqq -0.75°$ rises and now does not contain deep nulls. FIG. 7*b* illustrates the radiation pattern in comparison to a $\text{cosec}^2\theta$ curve. In a typical microwave power distribution system, such a $\text{cosec}^2\theta$ pattern is desirable as it serves to uniformly illuminate the service area extending from, for typical tower heights, approximately 0.5 miles to 15 miles from the tower.

The radiation patterns produced by the antenna configurations heretofore described are perhaps best illustrated with reference to FIG. 8, where they may be compared with each other and to the $\text{cosec}^2\theta$ pattern. Curve (a) shows a predicted pattern produced by the antenna of FIG. 6 with a 45° cone, D=24.00", F=9.00", L=5.00", d=0.27" and $H_T$=2.50", and operated at 28.5 GHz with a $TM_{01}$ horn. The predicted pattern for the same antenna with no absorber protrusion ($H_T$=0) is shown at curve (b). Curve (c) shows a predicted pattern that may be realized by changing the shape of the conical reflecting surface according to the mathematical equation (1), reproduced below, with N=3, the coefficients $A_0$=0, $A_1$=−1, $A_2$=0 and $A_3$=−1/1500, and the displacement distances $X_1$=0 and $X_3$=7.5.

$$Z_s = \sum_{n=0}^{N} A_n (X_s - X_n)^n \tag{1}$$

Using these parameters, equation (1) reduces to the following:

$$Z_s = -X_s - (1/5000)(X_s - 7.500)^3 \tag{2a}$$

If the Y axis is defined as the vertical axis rather than the Z axis, equation (2a) may alternatively be expressed as:

$$Y_s = -X_s - (1/5000)(X_s - 7.500)^3 \tag{2b}$$

Figure 8:
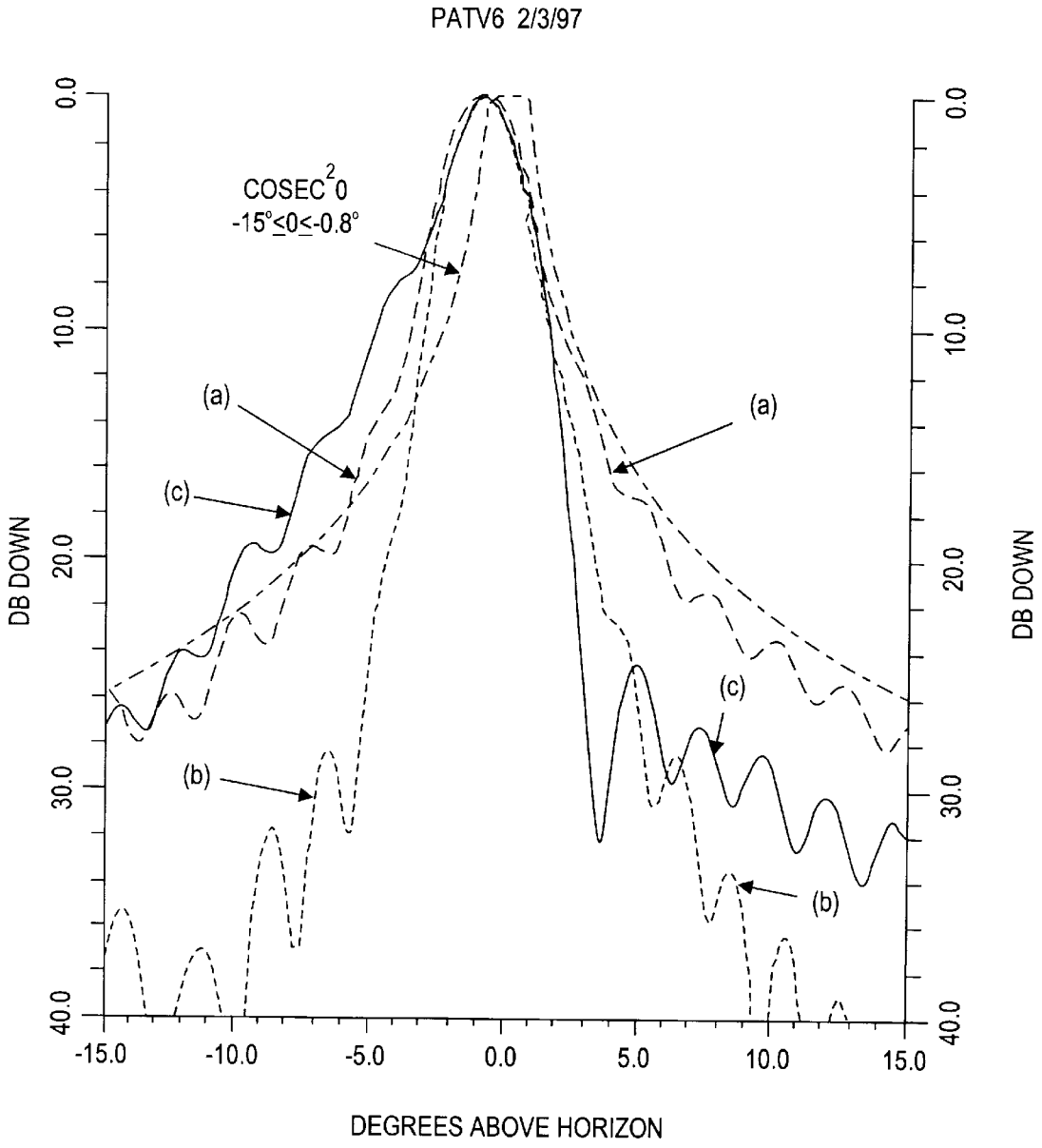
FIG. 8 shows predicted antenna patterns corresponding to three antenna configurations embodying principles of the present invention.

Through inspection of FIG. 8, it can be seen that a higher level of ground radiation (e.g., in the range of $-15 \leqq \theta \leqq -0.75°$) is produced in case (a) than in case (b), though the sky radiation (corresponding to the angular range of $\theta>0$) is too high. Curve (c) is the best pattern of the three, representing a pattern with substantially decreased sky radiation and a higher level of ground radiation with null-filling. Nevertheless, although curve (c) represents a desirable pattern, it will be appreciated that curve (c) is not necessarily an "ideal" pattern. Other patterns having desirable characteristics including, for example, wider ground coverage, various beam tilts, closer adherence to the the $\text{cosec}^2\theta$ pattern, etc. may be realized through alternative selections of the parameters N, $A_n$ and $X_n$ of equation (1).

Figure 9A:
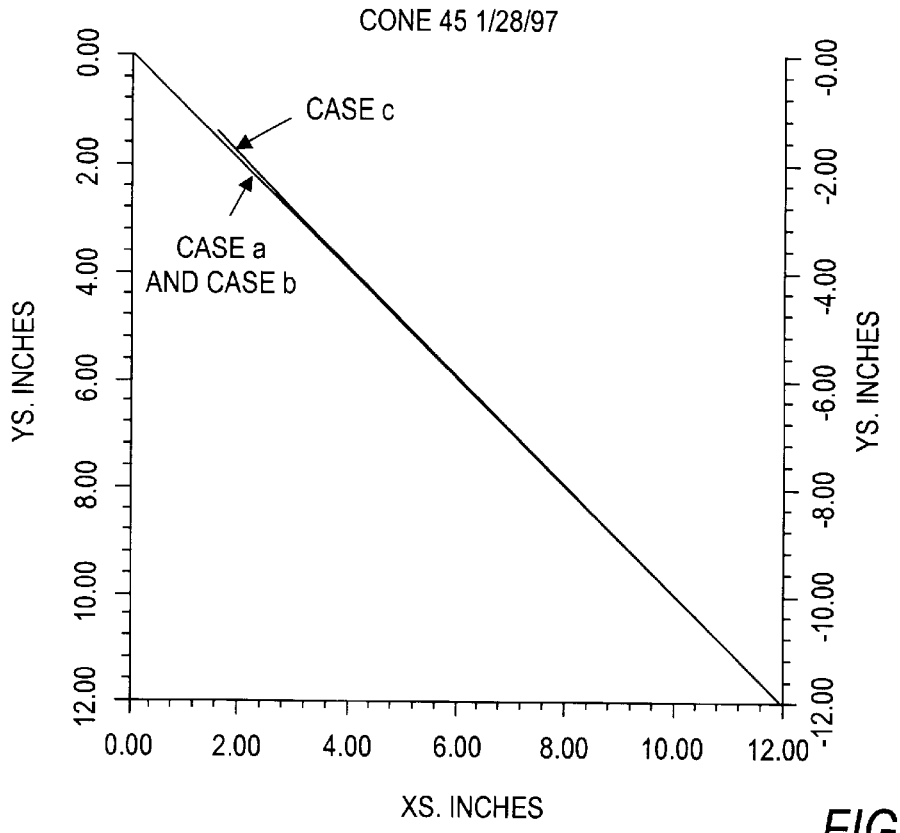
FIG. 9*a* depicts respective cone shapes of the three antenna configurations producing the predicted radiated patterns of FIG. 9.

The shape of the cone represented by equation (2b) above is represented by case (c) of FIG. 9*a*, while the shape of a −45° cone is represented by case (a) and (b) of FIG. 9*a*. By comparing case (c) to case (a) and (b), it is observed that the shape of the cone represented by equation (2b) is substantially similar to that of a −45° cone. However, it is noted that the cone represented by equation (2b) is truncated on the top. In one embodiment of the present invention, the flat portion on the top of the truncated cone is covered with absorber to collect the incident energy off the dish. However, it will be appreciated that the absorber lining is not mandatory because the incident energy is generally low due to a null on the axis of the horn.

Figure 9B:
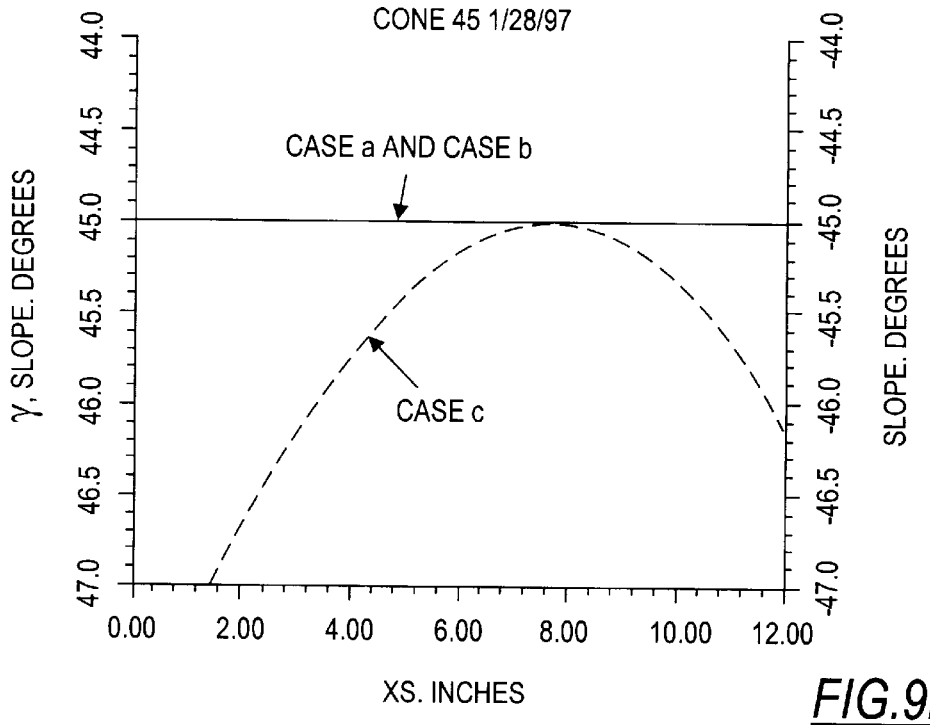
FIG. 9*b* depicts respective cone slopes of the three antenna configurations producing the predicted radiated patterns of FIG. 9.
Figure 10A:
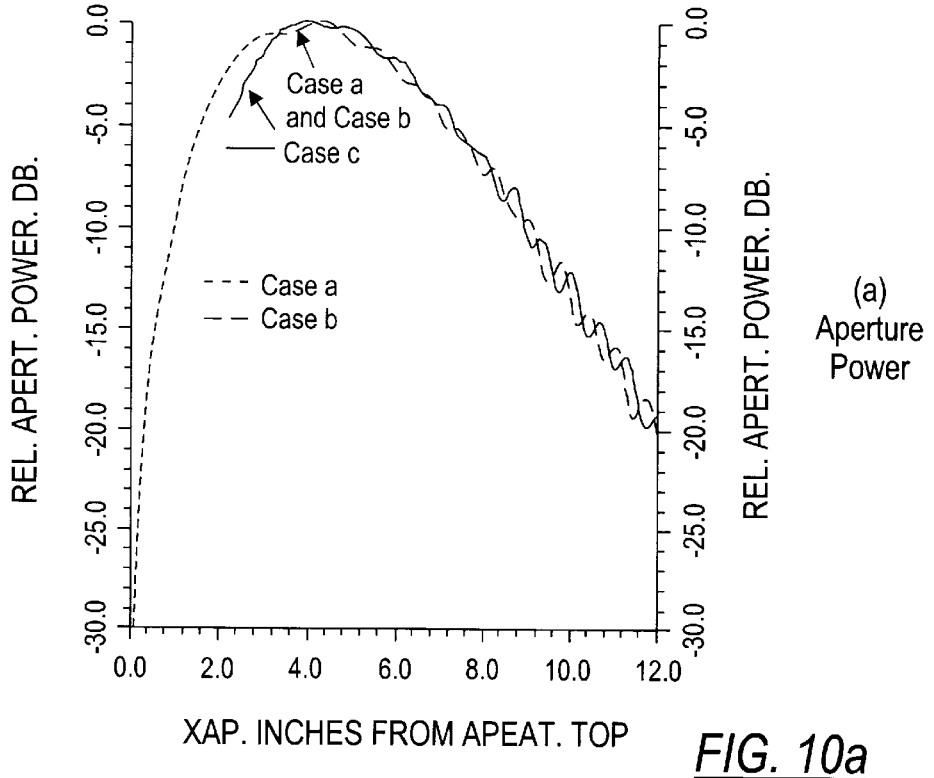
FIG. 10*a* shows predicted aperture power distributions of the three antenna configurations producing the radiated patterns of FIG. 9.
Figure 10B:
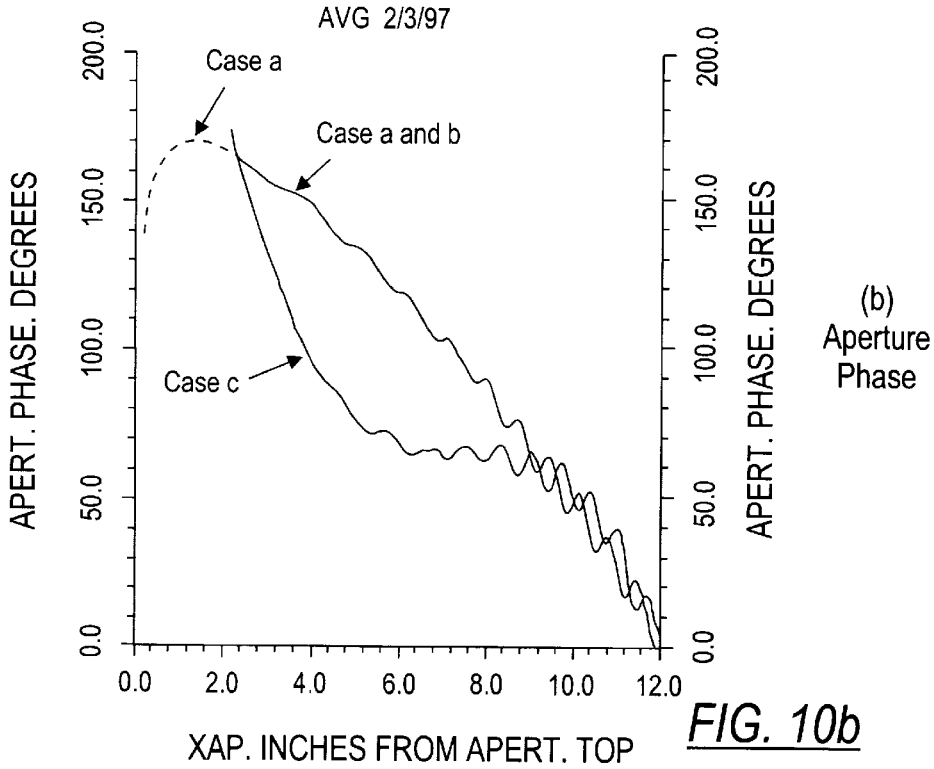
FIG. 10*b* shows predicted aperture phase distributions of the three antenna configurations producing the radiated patterns of FIG. 9.

Now referring to FIG. 9*b*, it is observed that the slope of the shaped cone (case (c)) is quite different (in degrees) than the slope of the −45° cone (case (a) and (b)). In FIG. 9*b*, the respective slopes are equal to tan γ, where γ is the angle the unit normal at the point ($x_s$, $y_s$) makes with the x axis. In FIG. 9*b* it is γ, in degrees, that is plotted against $x_s$. The difference in slopes between the shaped cone (case (c)) and the −45° cone (case (a) and (b)) results in different predicted aperture power and phase distributions, as shown in FIGS. 10*a* and 10*b*. It is primarily the phase difference between cases (b) and (c) that produce the improved pattern (FIG. 8), while it is the combination of both amplitude and phase changes between case (a) and (c) that produce the improved pattern.

It will be appreciated that the cone shaped according to equation (2b) may be employed in either of the antenna embodiments heretofore described to obtain a desired radiation pattern. For example, predicted curve (c) (FIG. 8) was obtained in an embodiment with D=24.00", F=9.00", L=5.00", d=0 and $H_T$=0, and operated at 28.5 GHz with a $TM_{01}$ horn. It is noted that the desired downward beam tilt in predicted curve (c) was obtained without moving the feed, and the improved ground coverage was obtained without extending the absorber.

The predicted curves (a), (b) and (c) were computed in the following manner. With reference to FIG. 6, the field at an arbitrary aperture point C is due to the vector sum of the fields reflected from the dish (e.g., ray OABC) and the fields emanating directly from the horn (e.g., ray OC), minus free space losses along OA for the ray OABC and along OC. (The free space loss along BC is trivial since β is very small.) The field so obtained is computed at each point along $X_{AP}$ and then integrated over the aperture range of $X_{AP}$ corresponding to the angular range $0 \leqq \Psi \leqq \Psi_D$ of the horn. To obtain the angle β (i.e., to locate C, i.e., $X_{AP}$, as a function of the horn angle Ψ), one invokes Snell's law at point B, namely α=γ+β. But α+γ=90 and tan γ=−1/($dy_s/dx_s$). Since $y_s$ vs. $x_s$ is specified, then $dy_s/dy_x$ and γ may be determined. Hence, since β=α−γ and α=90−γ, then β=90=2γ. For d=0, $x_s$=(F"A) sinΨ, with F"A=F/$\cos^2$(Ψ/2) (this being the equation of a parabola). Thus, since sinΨ=2cos(Ψ/2) sin (Ψ/2), we see that $x_s$=2Ftan(Ψ/2). Knowing $x_s$ and the equation for $y_s$ vs. $x_s$, we then obtain $y_s$. Then, since $X_{AP}$ (to the point C) is $X_{AP}=y_s+(D/2-x_s)\tan\beta$, we then obtain $X_{AP}$ as a function of Ψ. Finally, the above aperture fields are integrated over the range of $X_{AP}$ to obtain the radiation field. Of course, the entire computation is typically done by computer.

Figure 11:
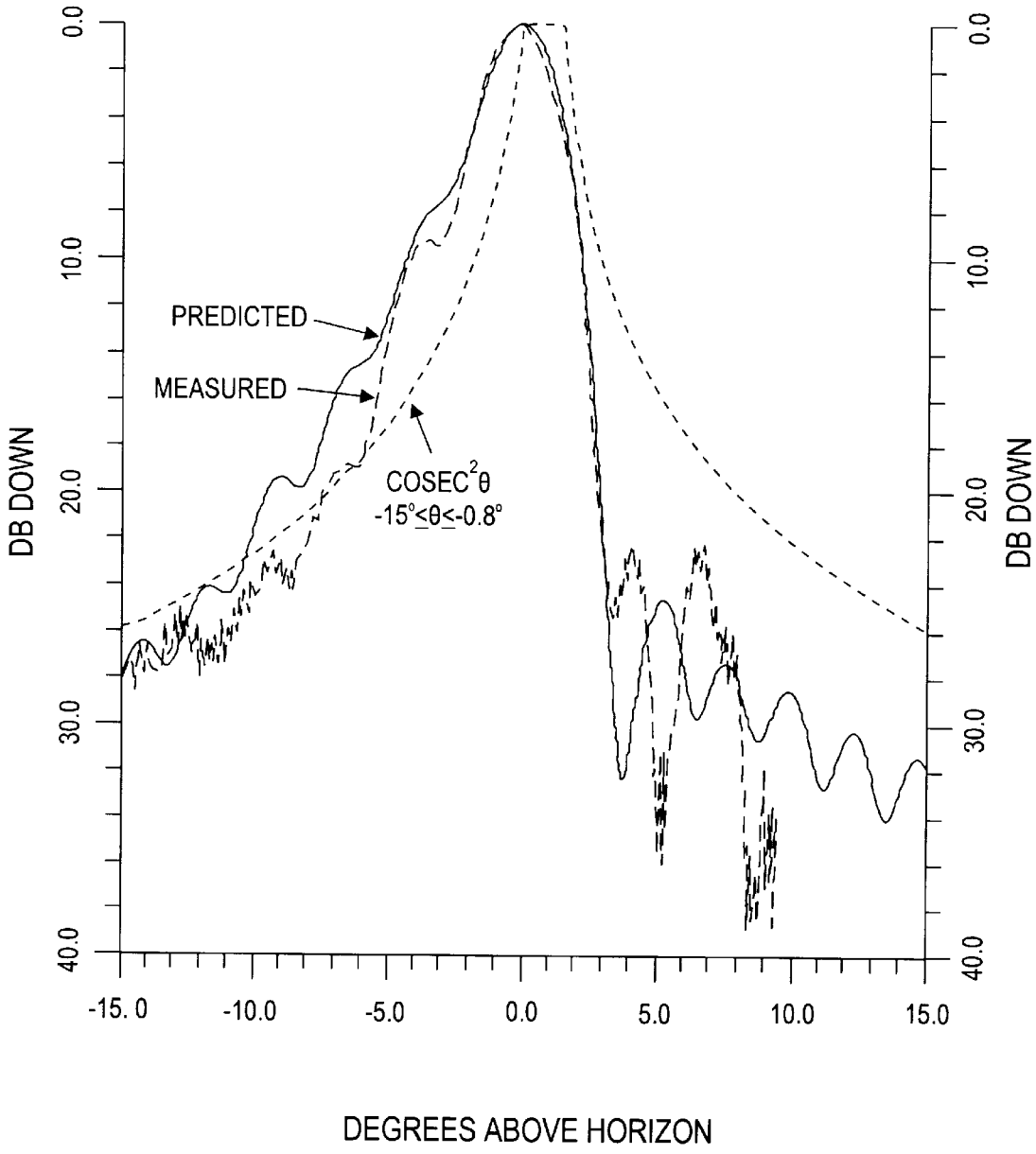
FIG. 11 compares measured and predicted vertically polarized radiation patterns produced by a shaped cone antenna embodying principles of the present invention.
Figure 12:
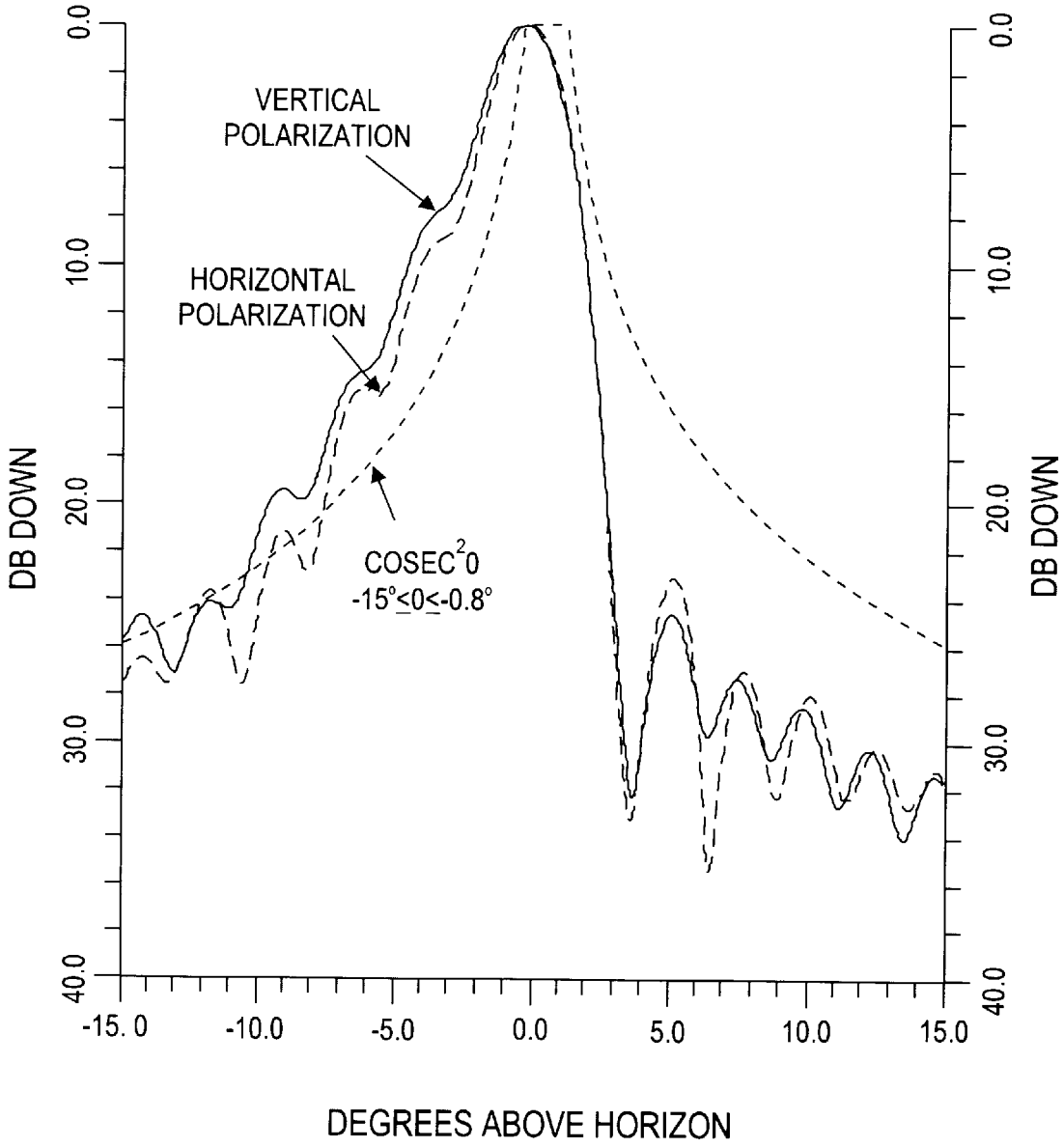
FIG. 12 compares the predicted vertically polarized radiated pattern shown in FIG. 11 to a predicted horizontally polarized radiation pattern produced by the same shaped cone antenna.

FIG. 11 compares the predicted radiation pattern of the shaped cone antenna (identical to case (c) of FIG. 8) with the measured radiation pattern produced with vertical polarization at 28.5 GHz. Inspection of FIG. 11 reveals that the predicted and measured patterns are in good agreement. Moreover, as shown in FIG. 12, the radiation patterns produced by the shaped cone antenna will be substantially the same whether employing vertical or horizontal polarization.

Figure 13:
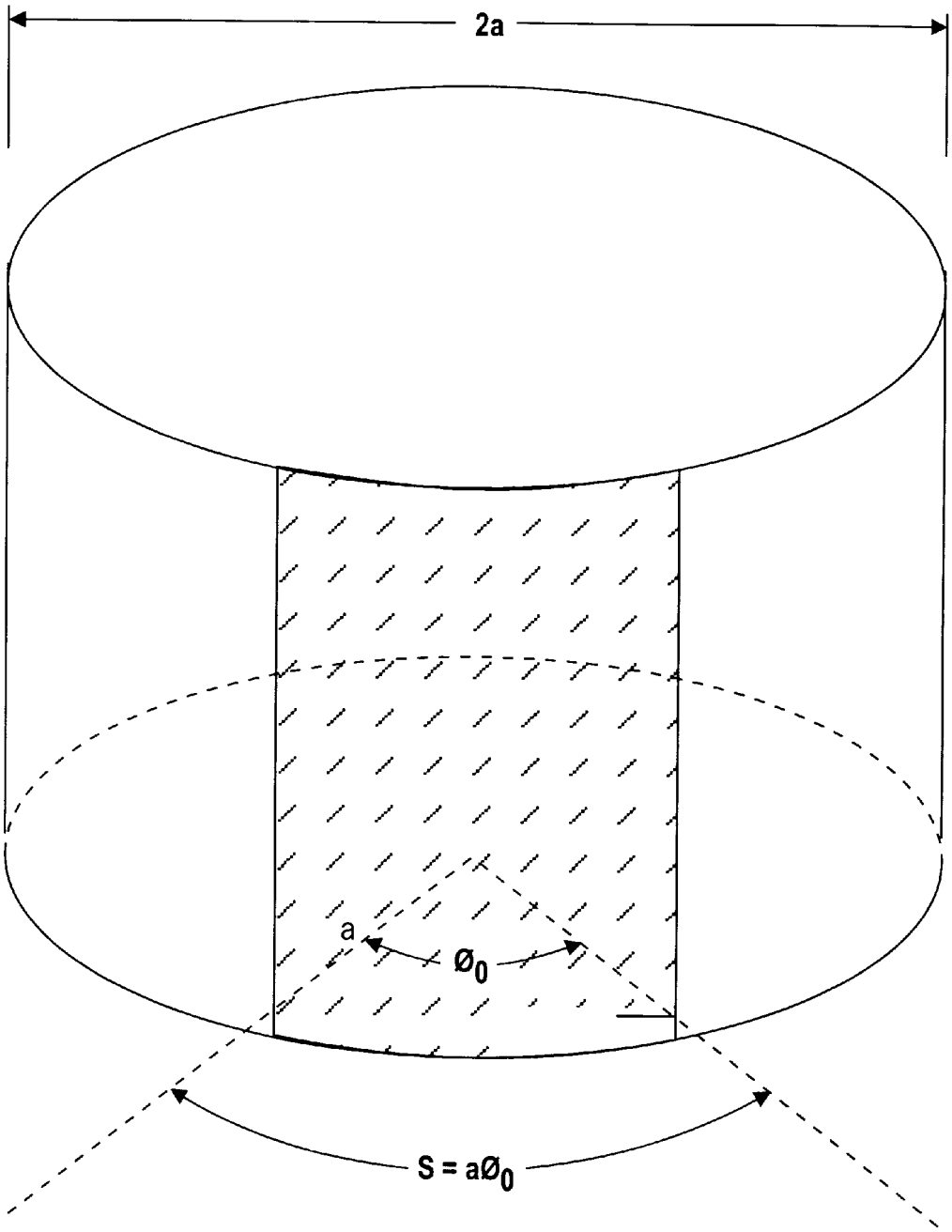
FIG. 13 is a diagrammatic illustration of another modification to the antenna of FIG. 1, to provide control over the azimuthal patterns as shown in FIGS. 14*a*–14*d;*
Figure 14A:
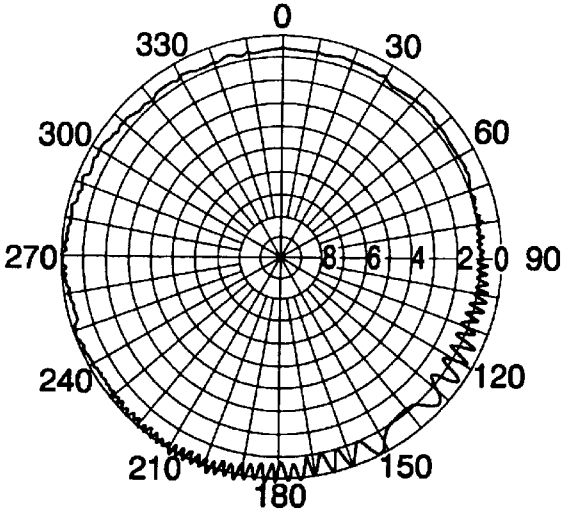
FIGS. 14*a*, 14*b* and 14*c* are measured azimuthal patterns produced by the antenna of FIG. 13.
Figure 14B:
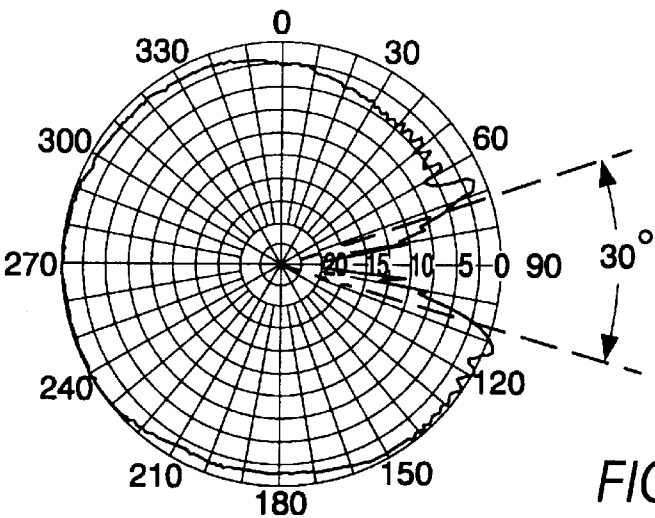
Figure 14C:
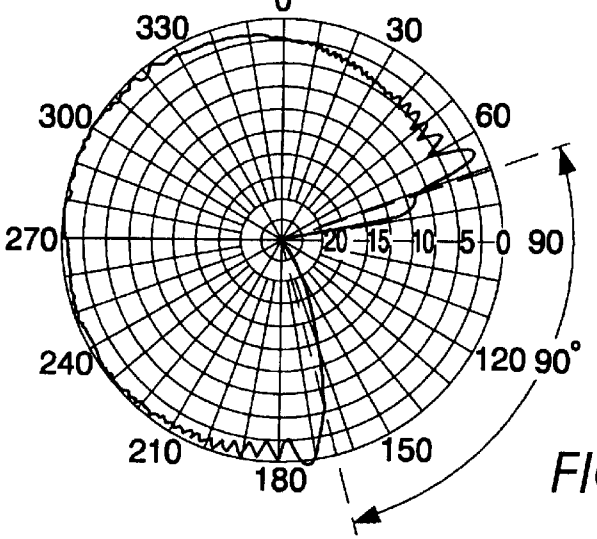
Figure 14D:
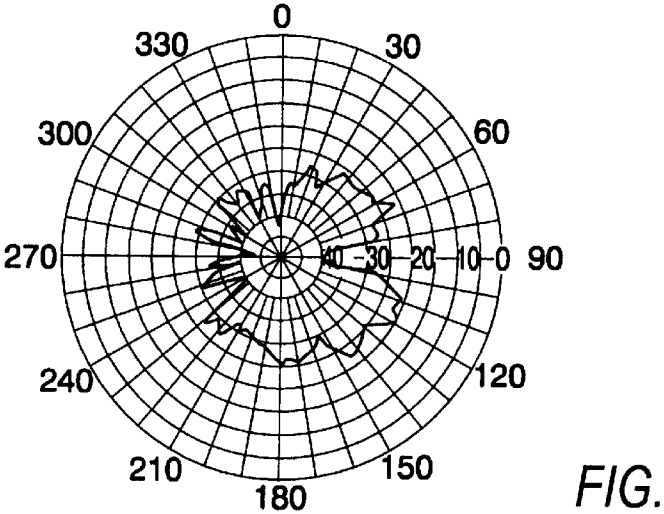
FIG. 14*d* shows the cross (and horizontal) polarization produced by the antenna of FIG. 13.

In some applications, complete azimuthal (horizontal) coverage is not required; in this case the subject antenna can be fitted with an absorber lining over an angular sector of the aperture (preferably on the inner surface of the radome), as shown in FIG. 13. The absorber has a width of approximately s=(a$\phi_0$)(π/180), where $\phi_0$ is the angular region (in degrees) not to be illuminated. Representative measured patterns on the antenna of FIG. 13 (with a=12.00" and f=28.5 GHz) for the cases of $\phi_0$=0°, 30° and 90° are shown in FIGS. 14*a*, 14*b* and 14*c*, respectively. FIG. 14*d* shows the cross (horizontal) polarization, which is virtually the same for all cases. For a given power input, the signal level to the illuminated region will not change with or without this absorber present and hence flexibility in azimuthal coverage is readily achieved by addition/deletion of this absorber.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. An omnidirectional microwave antenna comprising:

a paraboloidal reflector disposed above the ground and facing downwardly with a substantially horizontal aperture and a substantially vertical axis;

a vertically oriented feed horn located below said paraboloidal reflector on the axis of said paraboloidal reflector, said feed horn having a phase center positioned a distance, d, above the focal point of said paraboloidal reflector, where the value of d is selected to control the beam tilt of the radiation pattern produced by said antenna;

a radome extending downwardly from the outer periphery of said paraboloidal reflector and including an absorber material extending from the lower edge of said paraboloidal reflector to a distance, $H_T$, below the aperture of said feed horn, where the value of $H_T$ is selected to control the radiation pattern produced by said antenna; and a conical reflector having a shaped reflecting surface extending downwardly away from the periphery of said feed horn for reflecting radiation received vertically from said paraboloidal reflector in a horizontal direction away from said conical reflector, and for reflecting horizontally received radiation vertically to said paraboloidal reflector, said shaped reflecting surface being defined by a plurality of vertical coordinates, $Z_s$, a plurality of horizontal coordinates, $X_s$, and a plurality of arbitrary parameters N, $A_n$ and $X_n$, satisfying the equation $$Z_s = \sum_{n=0}^{N} A_n (X_s - X_n)^n.$$

2. The antenna of claim 1 wherein said shaped reflecting surface is defined by the equation $$Z_s = \sum_{n=0}^{N} A_n (X_s - X_n)^n$$

with N=1, $A_0$=0, $A_1$=−1, $X_0$=0 and $X_1$=0.

3. The antenna of claim 2 wherein d=0.27 inches and $H_T$=2.50 inches.

4. The antenna of claim 1 wherein said shaped reflecting surface is defined by the equation $$Z_s = \sum_{n=0}^{N} A_n (X_s - X_n)^n$$

with N=3, $A_0$=0, $A_1$=−1, $A_2$=0, $A_3$=−1/1500, $X_1$=0 and $X_3$=7.5.

5. An omnidirectional microwave antenna comprising:

a paraboloidal reflector disposed above the ground and facing downwardly with a substantially horizontal aperture and a substantially vertical axis;

a vertically oriented feed horn located below said paraboloidal reflector on the axis of said paraboloidal reflector, said feed horn having a phase center positioned a distance, d, above the focal point of said paraboloidal reflector, where the value of d is selected to control the beam tilt of the radiation pattern produced by said antenna;

a conical reflector having a shaped reflecting surface extending downwardly away from the periphery of said feed horn for reflecting radiation received vertically from said paraboloidal reflector in a horizontal direction away from said conical reflector, and for reflecting horizontally received radiation vertically to said paraboloidal reflector; and a radome extending downwardly from the outer periphery of said paraboloidal reflector and including an absorber material extending from the lower edge of said paraboloidal reflector;

wherein at least one of said conical reflector and said radome is adapted to modify the aperture distribution of said antenna so as to control the radiation pattern produced by said antenna.

6. The omnidirectional microwave antenna of claim 5 wherein said radome is adapted to modify said aperture distribution by said absorber material extending to a distance, $H_T$, below the aperture of said feed horn.

7. The antenna of claim 6 wherein $H_T$=2.50 inches.

8. The omnidirectional microwave antenna of claim 5 wherein said conical reflector is adapted to modify said aperture distribution according to the shaped reflecting surface of said conical reflector, said shaped reflecting surface having dimensions deemed by a plurality of vertical coordinates, $Z_s$, a plurality of horizontal coordinates, $X_s$, and a plurality of arbitrary parameters N, $A_n$ and $X_n$, satisfying the equation $$Z_s = \sum_{n=0}^{N} A_n (X_s - X_n)^n.$$

9. The antenna of claim 8 wherein said shaped reflecting surface is defined by the equation $$Z_s = \sum_{n=0}^{N} A_n (X_s - X_n)^n$$

with N=1, $A_0$=0, $A_1$=−1, $X_0$=0 and $X_1$=0.

10. The antenna of claim 8 wherein said shaped reflecting surface is defined by the equation $$Z_s = \sum_{n=0}^{N} A_n (X_s - X_n)^n$$

with N=3, $A_0$=0, $A_1$=−1, $A_2$=0, $A_3$−1/1500, $X_1$=0 and $X_3$=7.5.

11. The antenna of claim 6 wherein $H_T$=0.

* * * * *